US006684847B1

(12) United States Patent
Al-Hawaj

(10) Patent No.: US 6,684,847 B1
(45) Date of Patent: Feb. 3, 2004

(54) RADIAL VANE ROTARY DEVICE

(76) Inventor: Osama Al-Hawaj, P.O. Box 15462, Daiyah (KW), 35455

( * ) Notice: Subject to any disclaimer, the term of this patent is extended or adjusted under 35 U.S.C. 154(b) by 0 days.

(21) Appl. No.: 10/192,176

(22) Filed: Jul. 10, 2002

(51) Int. Cl.[7] ..... F02B 53/00
(52) U.S. Cl. ..... 123/243; 123/235; 418/219; 418/46
(58) Field of Search ..... 123/243, 235; 418/268, 267, 219, 46

(56) References Cited

U.S. PATENT DOCUMENTS

| | | | | | |
|---|---|---|---|---|---|
| 3,301,233 | A | * | 1/1967 | Dotto et al. | 123/243 |
| 3,589,841 | A | * | 6/1971 | De Lisse | 418/46 |
| 3,769,944 | A | * | 11/1973 | Raymond | 123/235 |
| 4,018,191 | A | | 4/1977 | Lloyd | 123/243 |
| 4,028,028 | A | * | 6/1977 | Fuchs, Jr. | 418/219 |
| 4,353,337 | A | | 10/1982 | Rosaen | 123/243 |
| 4,355,965 | A | | 10/1982 | Lowther | 418/268 |
| 5,415,141 | A | | 5/1995 | McCann | 123/263 |
| 5,509,793 | A | * | 4/1996 | Cherry et al. | 418/219 |
| 6,030,195 | A | | 2/2000 | Pingston | 418/268 |

FOREIGN PATENT DOCUMENTS

| | | | | |
|---|---|---|---|---|
| FR | 2578585 A1 | * | 9/1986 | F04C/15/04 |
| JP | 06307252 A | * | 11/1994 | F02B/53/00 |

* cited by examiner

*Primary Examiner*—Thomas Denion
*Assistant Examiner*—Thai Ba Trieu
(74) *Attorney, Agent, or Firm*—David Kiewit

(57) ABSTRACT

A family of sliding vane rotary power devices provides an internal combustion engine, a pump, a compressor, a fluid-driven motor, an expander device, a fluid-driven pump, a compressor or a throttling device. All of these devices have a rotor assembly with a number of vanes equally spaced about the rotor dividing the rotor chamber into discrete cavities. As the rotor turns, the vanes follow the wall contour of the rotor chamber so that the cavities rotate with the rotor and expand and contract as the rotor turns. Various combinations of smooth wall contours and rotational arrangements are provided in different devices in order to cause an appropriate number of expansions and contractions of a cavity during the course of a rotation. Various devices in the family of devices differ both in the shape of the rotor chamber and in the configuration of an internal stator member about which the rotor assembly turns.

35 Claims, 29 Drawing Sheets

RADIAL VANE ROTARY DEVICE

FIELD OF THE INVENTION

The invention relates to sliding vane rotary power devices, and more particularly to internal combustion engines, pumps, compressors, fluid-driven motors, expander devices, fluid-driven pumps and compressors or throttling devices, where various ones of those devices differ from others by a simple modification of a central stator member.

BACKGROUND OF THE INVENTION

Rotary power device of the radial vane type are characterized in having a rotor assembly comprising a number of vanes spaced about the rotor and dividing the rotor chamber into discrete cavities. As the rotor turns, the vanes follow the wall contour of the rotor chamber and thereby provide cavities that rotate with the rotor.

Sliding vane rotary devices generally comprise straight vanes slidably received within respective slots radially formed in a rotor. As the rotor spins, vanes are driven outward by centrifugal forces to an extent constrained by the wall contour, so as to execute radially reciprocating motion as the rotor spins. In an effort to increase the outward centrifugal force, a variety of sliding rotary devices have been developed. One class of devices uses a biasing spring disposed at the base of each vane. Another class uses a pair of controlling sidewall cam grooves engaged by sub-shafts fixed to lower side portions of a vane. Still another class uses a transfer passage connecting a pressurized fluid to the base of the vanes. Problems generally encountered by such devices include fluid slip, leakage, complexity associated of the disposition of intake and discharge, and lack of an ability to functionally modify the device to operate as either a pump or an IC engine. Examples of rotary devices of the above type can be found in United States patent such as U.S. Pat. No. 6,030,195 to Pingston, U.S. Pat. No. 4,355,965 to Lowther, U.S. Pat. No. 5,415,141 to McCann, U.S. Pat. No. 4,353,337 to Rosaen, and U.S. Pat. No. 4,018,191 to Lloyd.

SUMMARY OF THE INVENTION

This invention relates to a rotary power device of the radial vane type characterized in having a rotor assembly comprising a number of vanes equally spaced about the rotor and dividing the rotor chamber into discrete cavities. As the rotor turns, these vanes follow the wall contour of the rotor chamber and thereby provide cavities that rotate with the rotor and that expand and contract as the rotor turns. Various combinations of smooth wall contours and rotational arrangements are provided in different embodiments of the invention in order to cause an appropriate number of expansions and contractions of a cavity during the course of a rotation. In embodiments calling for a single expansion and a single contraction, a substantially circular rotor chamber may be used in combination with an eccentric shaft. In embodiments calling for two or more cycles of expansion and contraction, a rotor chamber having the appropriate number of lobes may be used in combination with a rotor turning about an axis through a center of the rotor chamber.

There are several preferred inventive combinations of rotor chamber shape and rotational arrangements for the rotor. Some of these are:

- A preferred two-cycle engine having a rotor chamber in which the wall contour forms a substantially circular wall eccentrically enclosing the rotor and forming two symmetrical halves of expanding and contracting cavities. In operation as a two-cycle engine, each cavity executes compression, power, and intake and exhaust scavenging processes during the course of each rotation of the rotor.
- A preferred rotary single-action pump having a rotor eccentrically disposed in a substantially circular rotor chamber so that the cavities expand and contract once during each rotation of the rotor assembly.
- A preferred four-cycle engine having a rotor chamber comprising an oval-shaped wall. The rotor chamber has a center coinciding with a shaft axis and forming four quadrants. Two diametrically opposed quadrants provide expanding cavities that are alternated by another two quadrants of contracting cavities. As a cavity moves through the four quadrant ranges it executes intake, compression, power and exhaust processes.
- A preferred double-action pump having a rotor concentrically disposed with respect to an elliptical chamber. In a double-action pump the cavities expand and contract twice during each rotation of the rotor assembly.

The present invention comprises a rotary power device that can be configured, among other things, to serve as either a two-cycle or a four-cycle internal combustion engine, or as a single-action or double-action pump by replacement of a stationary central member. Preferred embodiments of the invention comprise a generally toroidal rotor assembly fixedly secured to an end shaft and rotatably carried at one end of an external stator housing. The preferred rotor comprises a central bore communicating with a plurality of radial compartments that are open to a peripheral surface of the rotor and that will be hereinafter referred to as open-ended compartments.

The preferred rotor block also comprises a plurality of radial slots disposed in alternating relation with the radial compartments. Each radial slot is connected to an adjacent radial compartment by a transfer passage connecting the base of the slot with the compartment. An external stator portion of the device defines an internal volume that, when combined with the stationary central stator portion, defines a chamber for receiving the rotor. The preferred rotor chamber, when viewed in a medial section perpendicular to a rotational axis of the device, may appear as an ellipse or as a circle. Moreover, the rotor chamber may be concentric or eccentric with respect to the rotational axis of the device. Furthermore, preferred devices comprise an internal stator fixedly secured to the external stator and rotatably enclosed, with clearance, within the central bore of the rotor. The internal stator comprises channels connected to ports communicating with inner openings of the rotor compartments. As the rotor spins, a cavity formed between two adjacent vanes enclosing a radial compartment intermittently communicates with the ports in the internal stator so as to perform intake, compression, and power and exhaust functions. In addition to embodiments serving as internal combustion engines, the rotary device of the invention can function as pump or compressor by replacing the internal stator with one having the appropriate port and channel configuration.

One object of some embodiments of the invention is to provide an improved radial vane rotary power device that is light in weight, small in size and that has the minimum number of parts.

Another object of some embodiments of the invention is to provide a rotary power device that can be easily converted to other type of rotary power device such as, a pump, a compressor, or a work exchanger device by a simple modification or replacement of a central stationary member.

Another object of some embodiments of the invention is to provide a rotary power device that closely approximates continuous intake, compression, combustion and discharge processes.

Another object of some embodiments of the invention is to provide a rotary power device characterized by reduced noise and vibration.

Another object of some embodiments of the invention is to provide a rotary power device with minimum fluid slip and leakage.

These and other objects and advantages of the present invention will be apparent from the following detailed description and the appended claims. Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION

Figure 1:
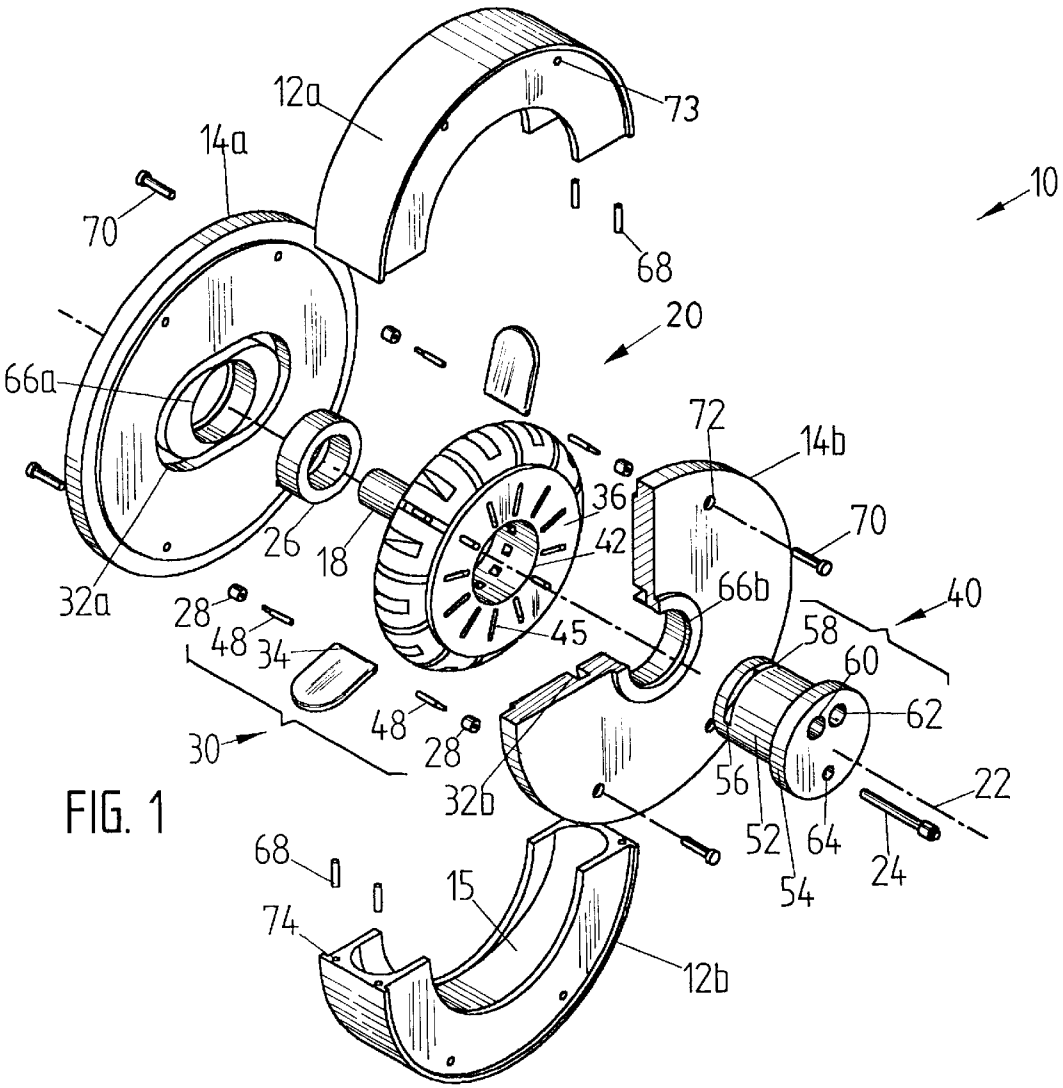
FIG. 1 is an exploded isometric view of a rotary power device of the invention having a portion of a housing cut away for purposes of illustration.

In FIGS. 1–7 of the drawing, the principles of this invention are illustrated through its application as a four-cycle internal combustion engine. It will be understood, however, that these principles can be successfully employed to yield other devices such as pumps, compressors, fluid driven motors, or fluid driven pumps or compressors through a simple modification or replacement of either or both of the internal and external stator portions.

The preferred rotary power device 10 comprises an external stator portion comprising a middle portion preferably formed from mating half portions 12*a*, 12*b*. The preferred external stator portion also comprises front 14*a* and back 14*b* end plate portions. The two middle half portions are preferably mated by means of alignment rods 68 inserted through holes 74. The end plate portions are preferably fixed to the middle half portions by fixture means such as bolts 70 inserted through aligned holes 72 and 73. The front end plate 14*a* preferably comprises an opening 66*a* for rotatably mounting a rotor 20 and an end shaft 18 by means of a suitable bearing 26. A preferred back end plate 14*b* includes an opening 66*b* for fixedly mounting an internal stator potion 40 by known fixturing means (not shown). The inner face of the front and back end plates may further comprise respective cam grooves 32*a* and 32*b*.

Figure 5:
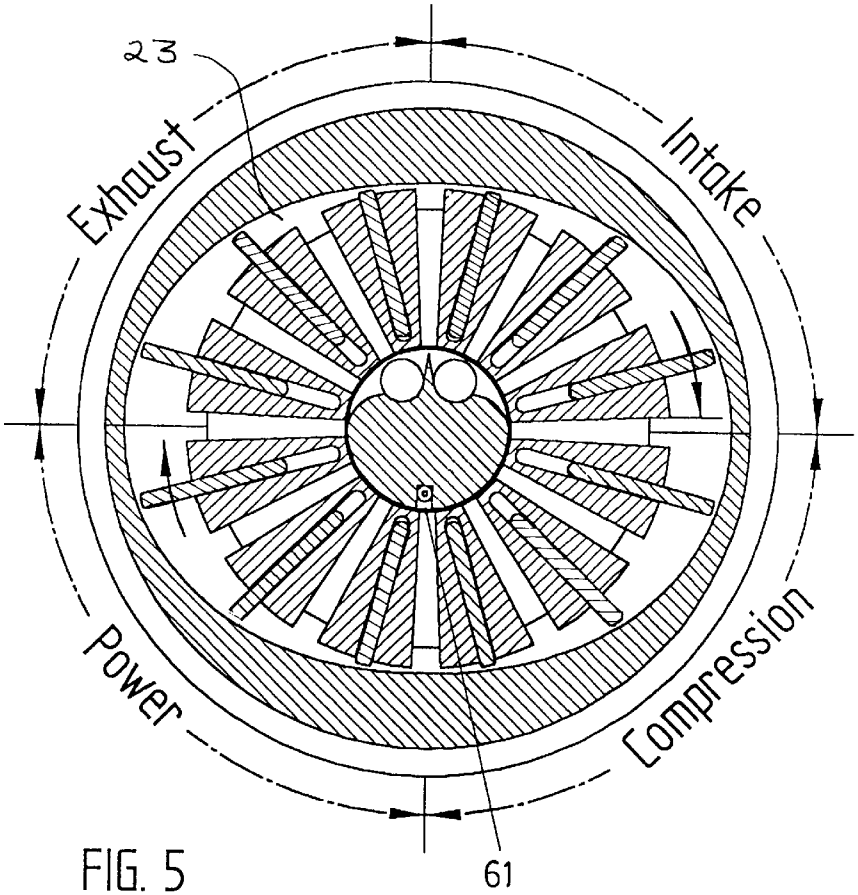
FIG. 5 is a cross-sectional view taken along 5—5 of FIG. 4.

A medial cross-section of the external stator, taken transverse to an axis of rotation 22 of the device 10 shows that the rotor chamber 23 of a preferred four cycle engine embodiment of the invention (e.g., as depicted in FIG. 5) has an elliptical wall 15 having a central axis coinciding with the axis of rotation 22. More generally, the shape of the medial cross-section of the rotor chamber 23 is a smooth curve selected so that rotor vanes 34 cooperate with the rotor chamber wall to produce an appropriate number of radially inward and outward reciprocations of the vanes 34 during each rotation of the rotor. In devices analogous to four or more cycle internal combustion engines, this cooperative effect may be obtained by a combination of a lobed chamber wall (where an oval or elliptical shape provides two lobes) and a rotor turning concentrically with respect to the rotor chamber 23. In two-cycle engines, single-acting pumps and other such analogous devices, subsequent portions of this disclosure will describe rotor chambers that, when viewed in the same section, have a circular inner wall eccentrically disposed with respect to an axis of rotation of a shaft of those devices.

Figure 2:
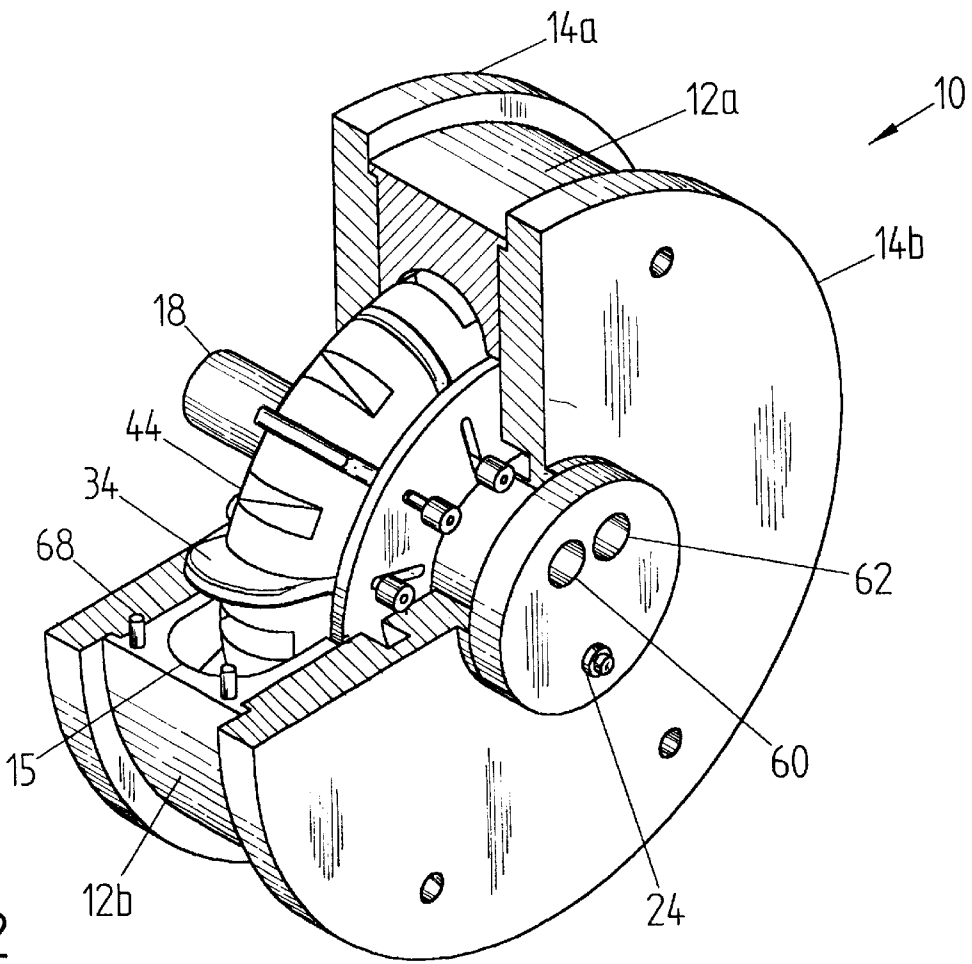
FIG. 2 is an isometric view of a rotary power device of the invention in which an external stator portion is partially cut away for purposes of illustration.

For any of the choices of rotor chamber shape defined with respect to a section perpendicular to the axis of rotation, when viewed in a cross-section or cut-away taken parallel to the axis of shaft rotation (e.g., as seen in FIG. 2) the portion of the rotor chamber wall 15 formed by the middle portion of a preferred external stator is seen to have a semi-circular profile, a central point of which traces the ellipse, circle, or other smooth curve when followed along a plane perpendicular to the axis of the shaft. Correspondingly, both an outer edge portion of a vane cooperating with the rotor chamber 23, and a peripheral portion of a preferred rotor have matching semi-circular profiles.

Figure 3:
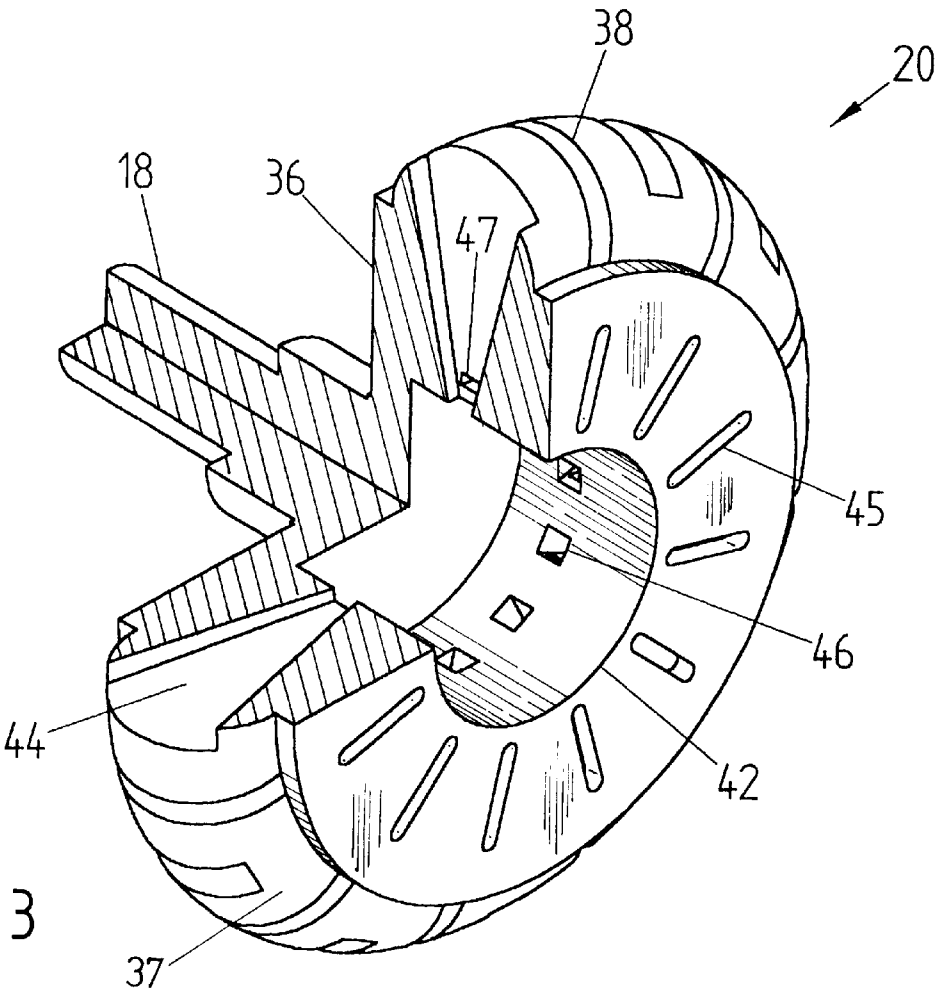
FIG. 3 is an isometric view of a rotor having a portion cut away for purposes of illustration.

A rotor assembly 20 of the preferred four-cycle engine may be concentrically mounted within the annular rotor chamber 23 defined by the inner wall of the middle portions, the inner wall of the front and back end plates, and the peripheral wall of the central internal stator. A preferred rotor assembly comprises a block 36 fixedly connected to or integrally formed with a central shaft 18 having an axis coincident with the axis of the device 22. A preferred block includes a peripheral wall portion 37 that is cylindrical in the sense of having a single selected maximum radial extent from the axis of rotation 22 for any choice of angle about the shaft 18. Moreover, the peripheral portion 37 of the cylindrical block comprises a semi-circular profile when viewed in a cross-section taken in a plane containing the axis of the device, as depicted in FIG. 3. This semi-circular profile cooperates with the semi-circular profile of the wall 15, which is the inner wall of the external stator's middle portion and the outer wall of the rotor chamber 23. The cylindrical block may further comprise a central bore 42 communicating with a plurality of open-ended radial compartments 44 through respective inner openings 46. There is also an equal multiplicity of radial slots 38 that are disposed in alternating relation with the radial compartments, where each radial slot communicates at a lower portion with an adjacent radial compartment by means of a respective transfer passage 47. A multiplicity of vane assemblies 30 is preferably disposed in the rotor chamber 23, and arranged so that each vane assembly includes a respective vane plate portion 34, a respective pin 48 fixable to the base of the vane and protruding through a respective rotor cam slot 45, and a respective cam follower roller 28 rotatably mounted at pin end 48 and engaging a guide cam groove 32*a* and 32*b*. As the rotor spins, the vanes reciprocate outward and inward along respective radii where the motion of the vanes is controlled by the side cam or inner wall cam, and the vane tips contact or come close to contacting the inner wall of the middle portion of the external stator.

The central internal stator 40, as shown in FIG. 1 and FIG. 2, comprises a cylindrical portion 52 extending coaxially through the opening 66*b* into engagement with the interior of the rotor 20, and an end flange portion 54 for fixedly attaching the cylindrical portion 52 to the back end plate 14*b* by suitable fixture means (not shown). Alternatively, the central internal stator 40 may be manufactured as a cylindrical projection from the back end plate. A preferred cylindrical portion 52 is provided with two peripheral cutout openings forming angularly adjacent intake 56 and exhaust 58 ports. Each port opening is defined within an approximate angular extension of 90° and has an angularly varying radial depth profile. These lateral openings respectively communicate with an axial intake channel 62 and an exhaust channel 60 connecting these ports to the exterior. An ignition port 61 is disposed approximately diametrically opposite to the angularly adjacent pair of intake and discharge ports and is connected to an axial ignition channel 64 that is preferably provided with an ignition means such a spark plug 24 or a glow plug, as appropriate.

Figure 2A:
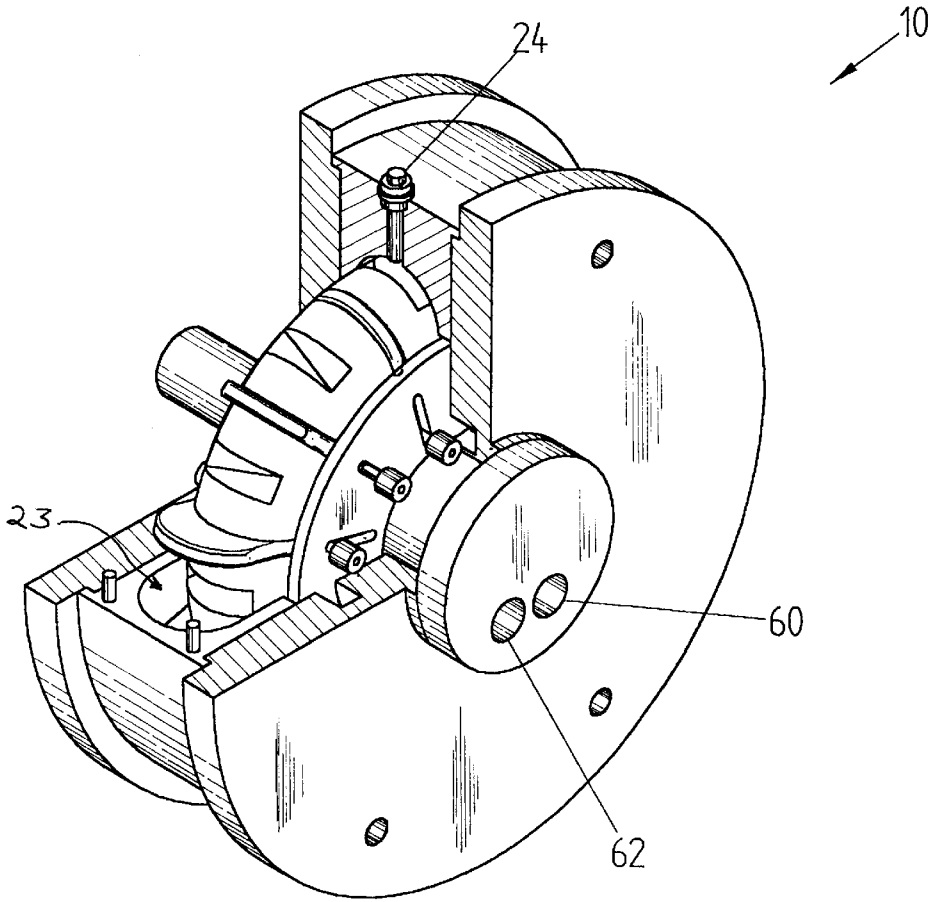
FIG. 2*a* is an alternative isometric view of the rotary power device of FIG. 2 in which the ignition means is disposed in the external stator portion.

Another embodiment is the four-cycle rotary power device shown in FIG. 2*a* in which the internal stator comprises an intake passageway 62 and an exhaust passageway 60, but in which the ignition means 24 is disposed in the external stator portion.

Figure 2B:
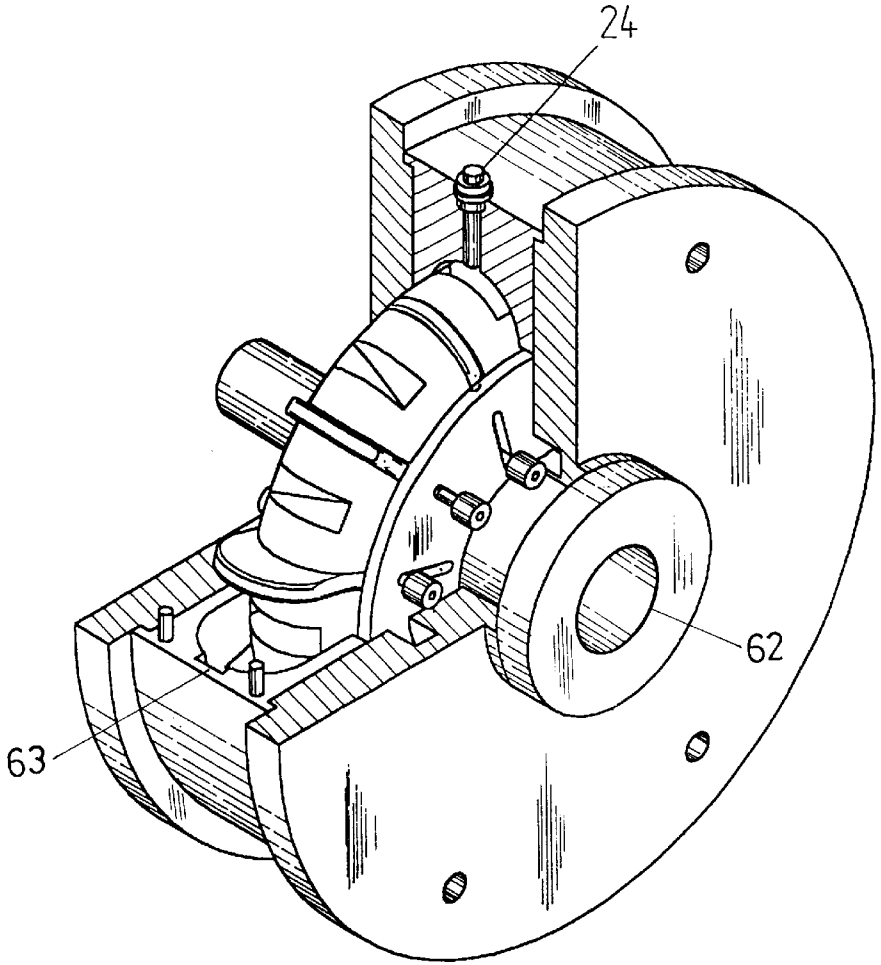
FIG. 2*b* is an alternative isometric view of the rotary power device of FIG. 2 in which the ignition means and exhaust passageway are disposed in the external stator portion.
Figure 5A:
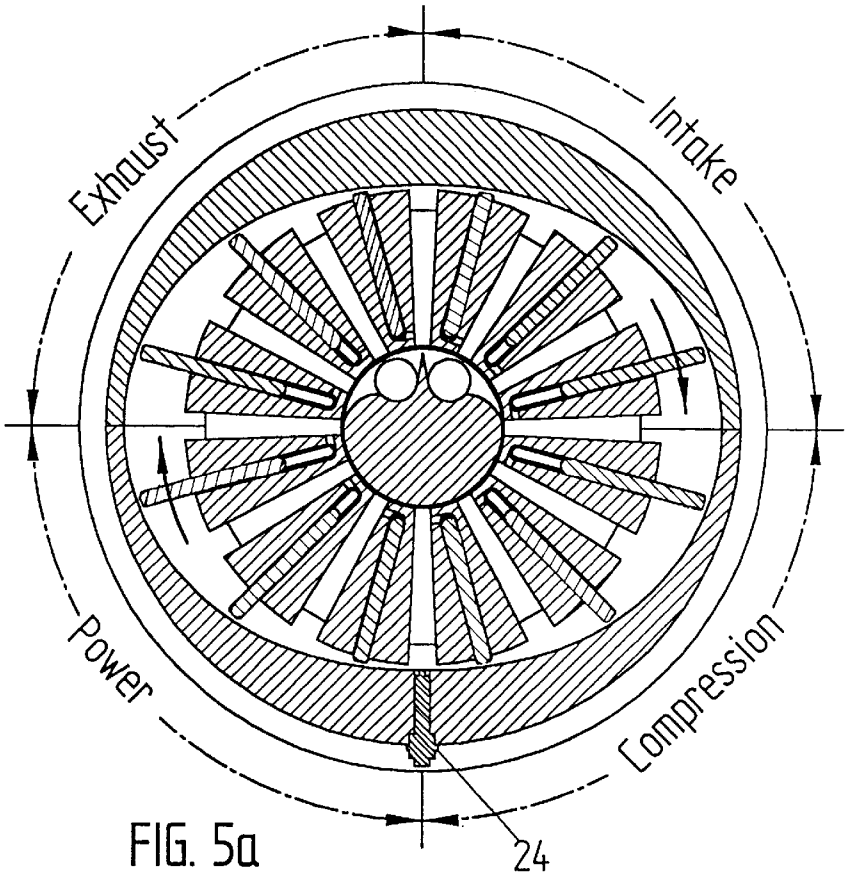
FIG. 5*a* is a cross-sectional view taken along 5*a*—5*a* of FIG. 4*a*.
Figure 4A:
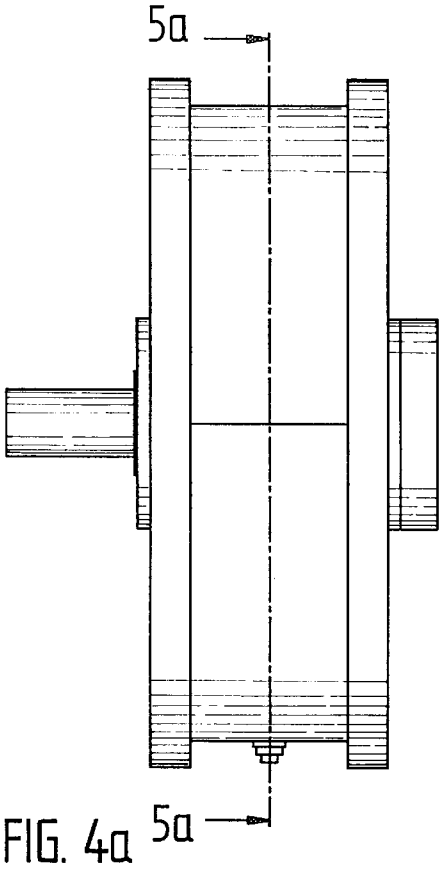
FIG. 4*a* is a side elevation view of the rotary power device of FIG. 2*a*.
Figure 5B:
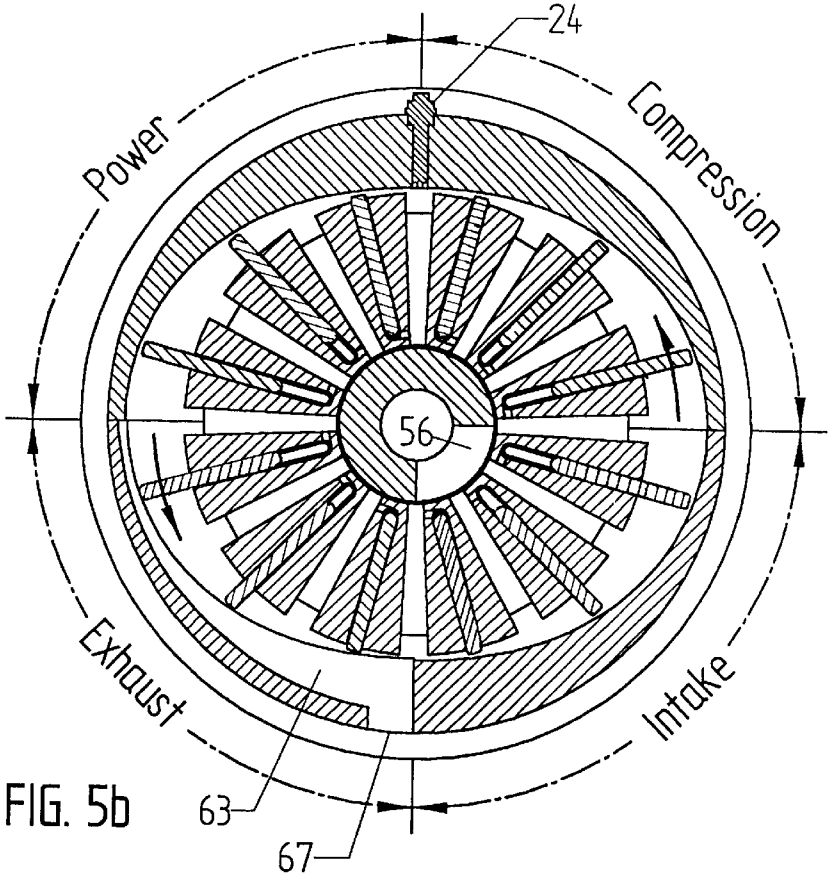
FIG. 5*b* is a cross-sectional view taken along 5*b*—5*b* of FIG. 4*b*.
Figure 4B:
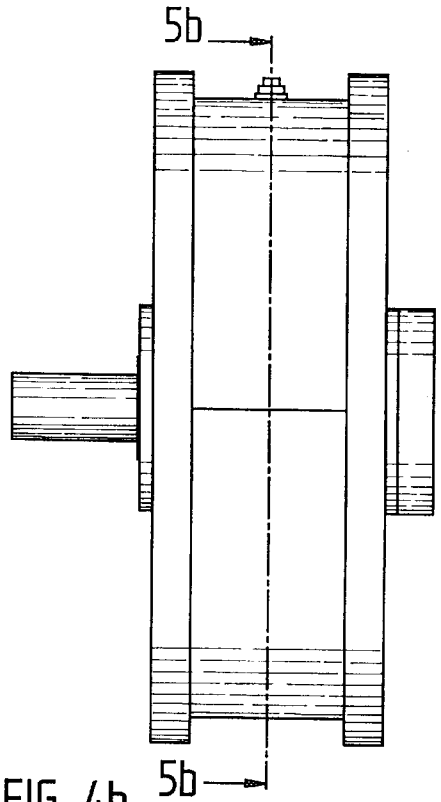
FIG. 4*b* is a side elevation view of the rotary power device of FIG. 2*b*.
Figure 6:
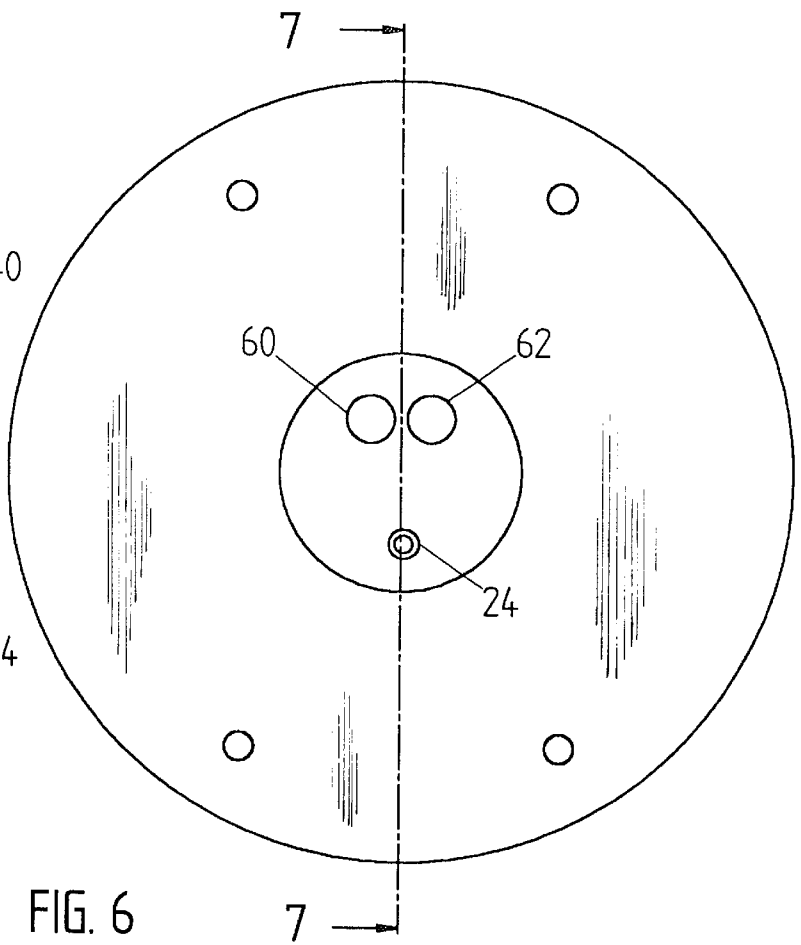
FIG. 6 is an end view of the rotary power device of FIG. 2.
Figure 7:
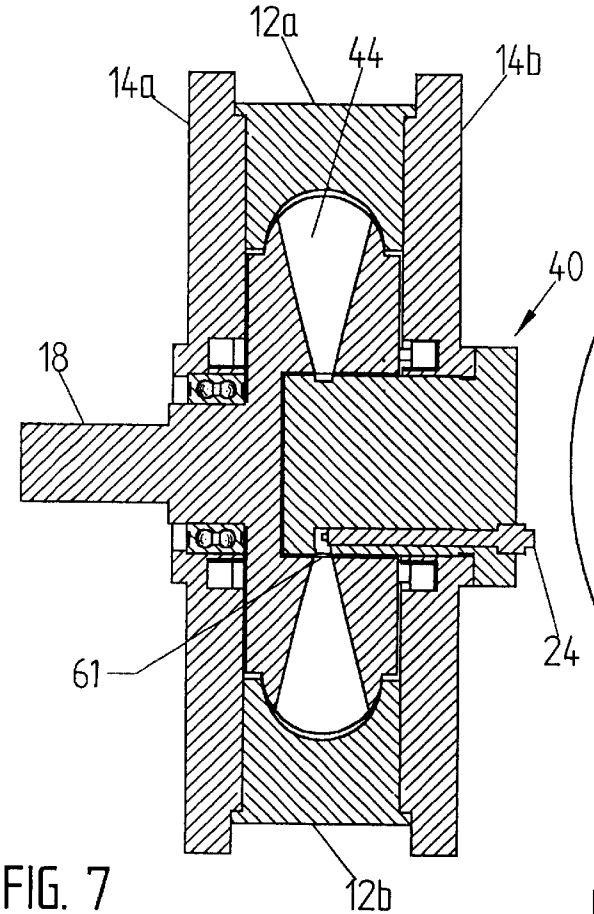
FIG. 7 is a cross-sectional view taken along 7—7 of FIG. 6.

Still another embodiment of a four-cycle rotary power device is shown in FIG. 2*b* in which the internal stator portion comprises an intake passageway 62; but the exhaust passageway 63 and the ignition means 24 are disposed in the external stator portion. In this embodiment the exhaust passageway 63 comprises a groove cut into the inner peripheral wall of the external stator. The groove is defined over a 90° angular displacement and is connected to a discharge port 67, as shown in FIG. 5*b*.

Figure 4:
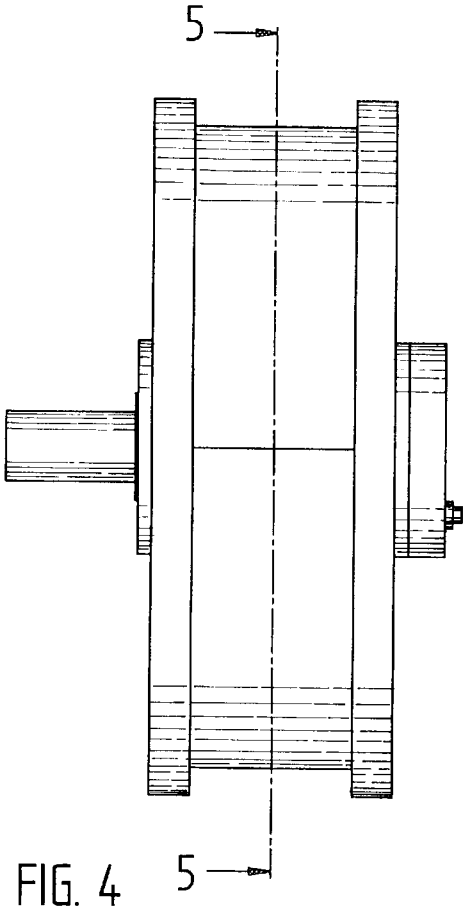
FIG. 4 is a side elevation view of the rotary power device of FIG. 2.

In operation as a four-cycle internal combustion engine, a starter motor (not shown) is connected to the shaft 18 to initiate the rotation of the rotor 20 to start the engine. Each cavity is bounded by two adjacent extended vanes and encloses a radial compartment that moves through four phases comprising intake, compression, power and discharge phases, each phase taking place within a 90° angular displacement of the rotor. Step by step operation of the four phase internal combustion is explained with reference to FIG. 5. For example, consider the movement of a cavity bounded by two adjacent vanes that starts at the top-most position where the volume is minimum, which corresponds to top dead center (TDC) in a conventional reciprocating engine. As the rotor turns, the volume increases gradually and the inlet port 56 of the central stator comes into communication with the intake channel 62 which registers with inner openings 46 of the rotor, so as to perform intake of a fuel/air mixture. This phase terminates at a maximum volume position corresponding to the first bottom dead center (BDC) position in a conventional engine. During the second phase, the cavity volume decreases and the compartment inner opening 46 is blocked by the cylindrical wall portion 52 of the central stator, thereby compressing the charge. This phase terminates at a second minimum volume corresponding to the second (TDC) in a conventional engine. During the third phase, the compressed charge is ignited as the cavity registers with the ignition port 61 comprising ignition means such as a glow plug or spark plug 24. The ignition means 24 may be disposed in the internal stator as shown in FIG. 4 and FIG. 5 or in the external stator as shown in FIGS. 5*a* and 5*b*. Subsequent to ignition, a power phase is initiated in which the volume increases and the compartment inner openings 46 are blocked again by the cylindrical wall portion 52. The effect of the resultant pressure forces of the expanding gases on the extended vanes provides a larger tangential force on that vane having the larger extended area, which provides the propelling torque, causing the rotation of the rotor. The expansion process continues until the cavity volume reaches a maximum, corresponding to the second (BDC) position in a conventional engine. At the beginning of the fourth phase, blow down of combustion products is followed by an exhaust process as the volume decreases while the inner opening 46 registers with the exhaust port 58, thus further expelling the combustion products through a channel 60 as shown in FIG. 2, FIG. 2*a*. FIG. 5 and FIG. 5*a*. Alternatively, the combustion products are expelled through the exhaust passageway 63 in the external stator leading to an exhaust port 67 as the open-ended compartment registers with the passageway, as shown in FIG. 5*b*. Thus, as the cavity completes one revolution, it executes one complete four-cycle operation comprising intake, compression, power, and exhaust phases.

Figure 8:
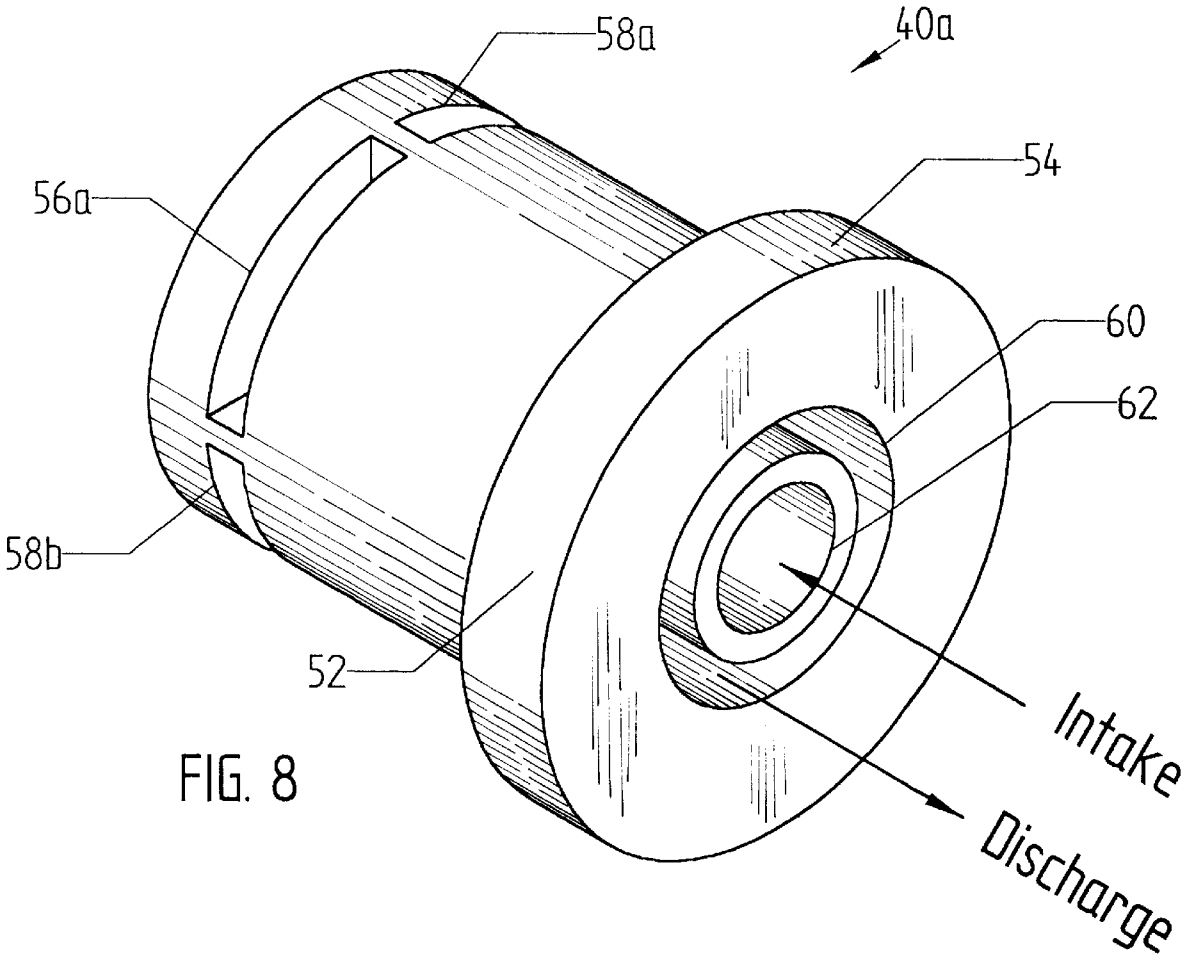
FIG. 8 is an isometric view of an alternate central internal stator for a power device of the present invention.
Figure 8A:
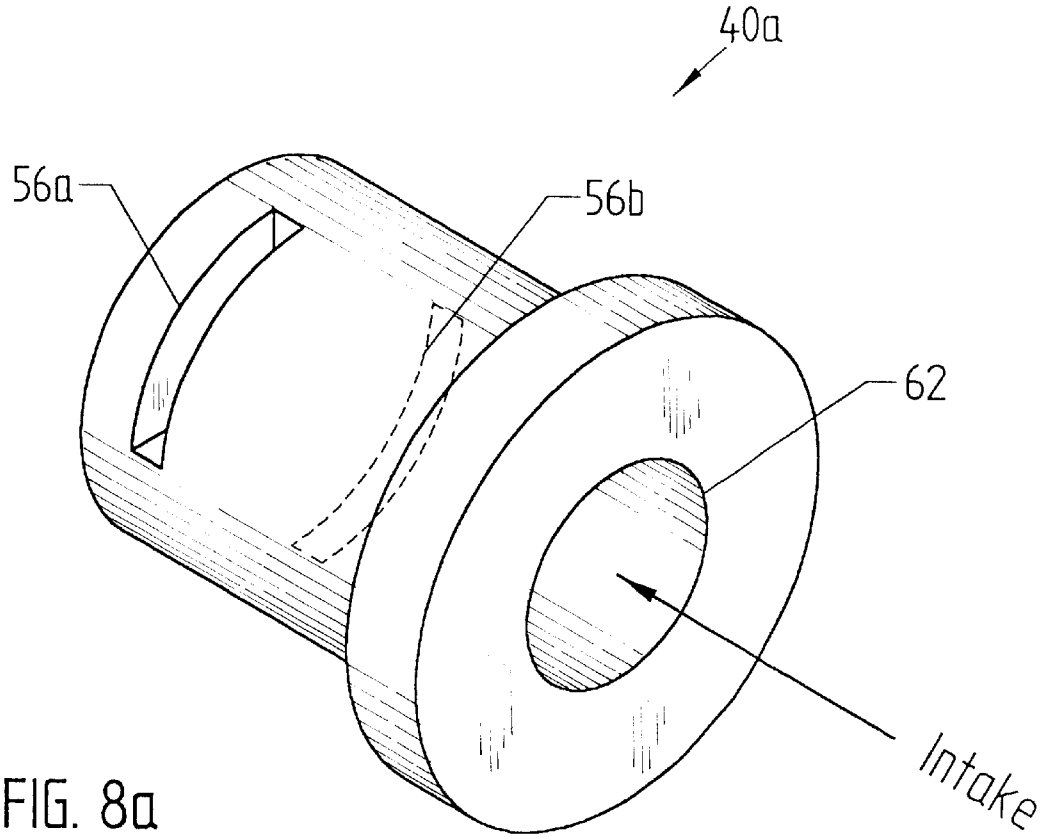
FIG. 8*a* is an isometric view of another alternate central internal stator for a power device of the present invention.
Figure 9:
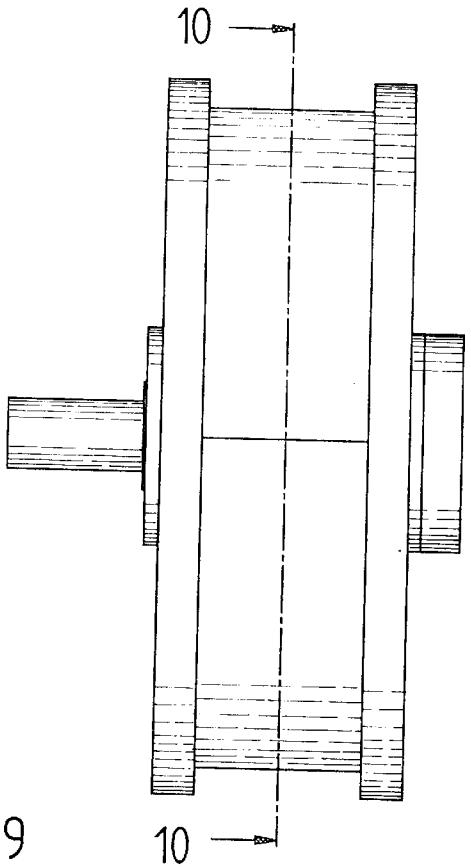
FIG. 9 is a side view of the rotary power device of FIG. 1 employing the alternate internal stator of FIG. 8.
Figure 10:
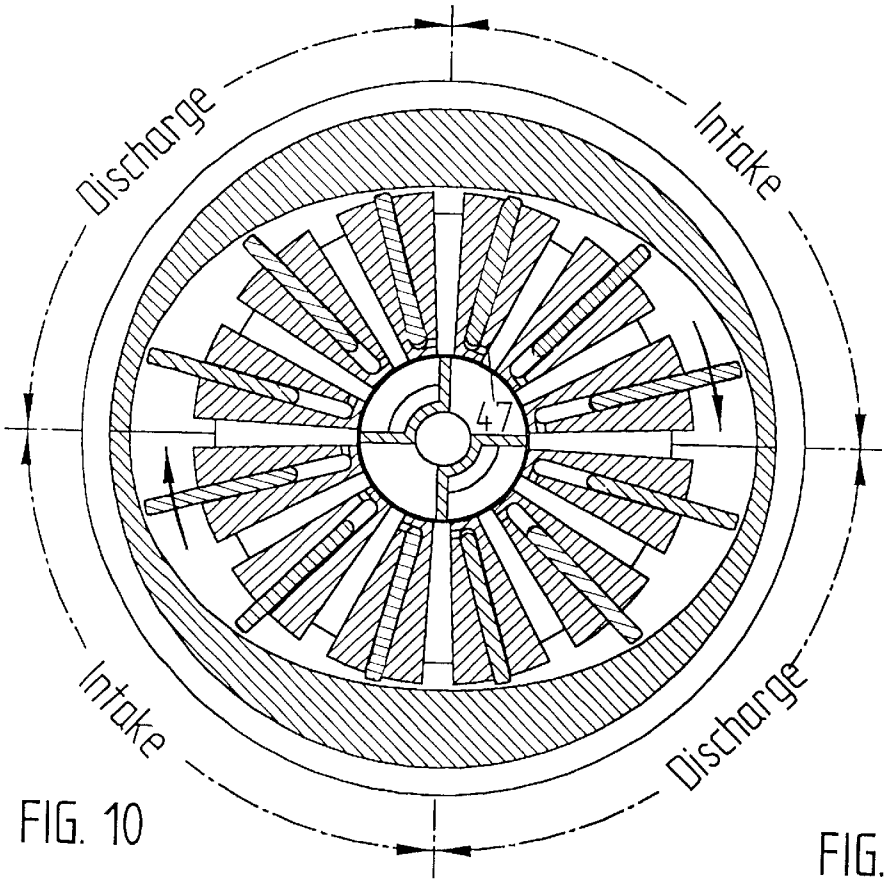
FIG. 10 is a cross-sectional view taken along line 10—10 of FIG. 9 of a rotary power device of the invention that uses the alternate central stator of FIG. 8 and that is capable functioning as a double-action pump, a double-action compressor, a double-action expander or a fluid-driven motor.
Figure 10A:
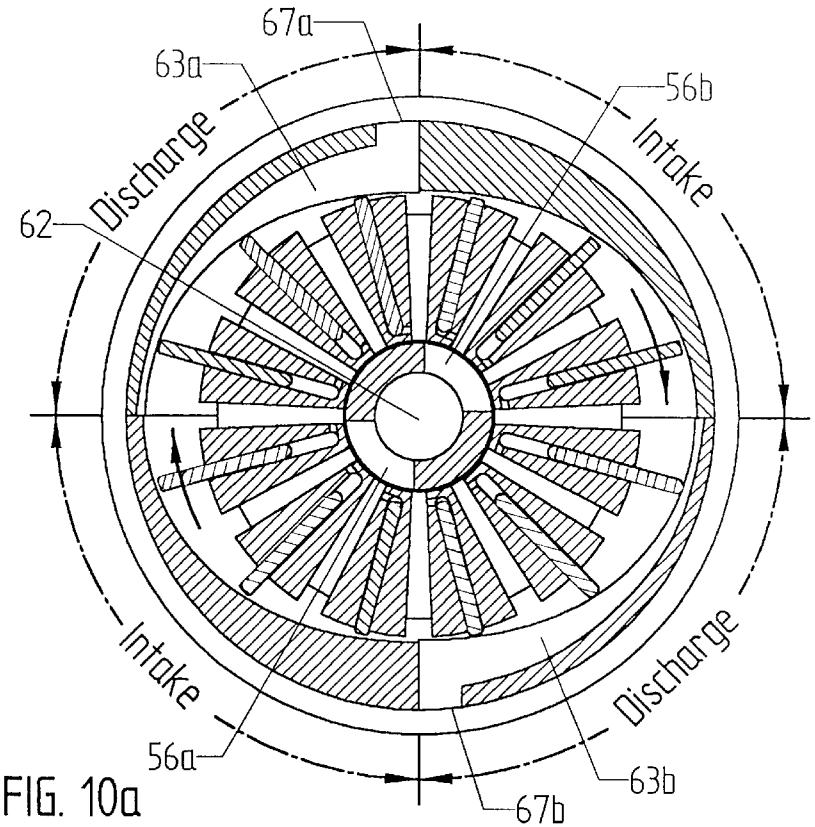
FIG. 10*a* is a cross-sectional view taken along line 10*a*—10*a* of FIG. 9*a* of a rotary power device of the invention that uses the alternate central stator of FIG. 8*a* and that is capable of functioning as a double-action pump, a double-action compressor, a double-action expander or a fluid-driven motor.
Figure 9A:
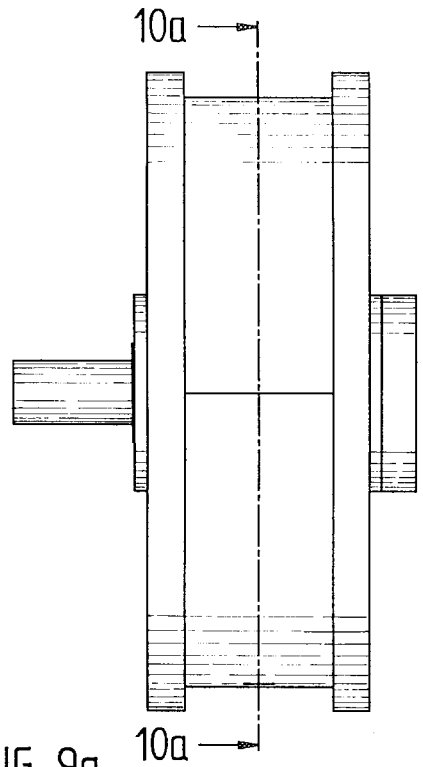
FIG. 9*a* is a side view of the rotary power device of FIG. 1 employing the alternate internal stator of FIG. 8*a*.

The rotary power device 10 can be easily converted to serve a different purpose than that of an internal combustion engine by simple replacement of the internal stator 40 with the alternative central stator 40*a* shown in FIG. 8 and FIG. 8*a*. A rotary power device employing the alternative central stator 40*a* can function as a double-action compressor, a pump, an expander or as a fluid-driven motor. In the configuration of FIG. 8, the central stator comprises two diagonally disposed intake ports 56*a* and 56*b* alternated by two diagonally disposed exhaust ports 58*a* and 58*b*. Each port is formed as a respective cutout in the peripheral wall of the internal stator portion and is defined within a 90° angular extension. The two intake ports are connected to a common intake channel 62, and the two exhaust ports are connected to a common exhaust channel 60. One channel may comprises a central channel and the second may comprises an annular channel concentric with the central channel. In another alternative configuration, depicted in FIG. 8*a*, the internal stator comprises only two diagonally disposed intake ports 56*a* and 56*b* connected to a common intake passageway 62; and the external stator comprises two diagonally disposed discharge passageways 63*a* and 63*b* connected to respective discharge ports 67*a* and 67*b* as shown in FIG. 10*a*.

When functioning as a pump or compressor, the rotor is made to rotate by coupling the end shaft 18 to a driving means such as a motor. Centrifugal force urges the vanes 34 outward and is assisted by fluid pressure communicated to the base of the vanes through a transfer passage 47. A sealed cavity is enclosed between two vanes having outer vane tips making contact engagement with the toroidal and side wall of the rotor chamber 23 through spring biased vane tips (not shown) or, alternatively, making a small clearance engagement with the walls for vanes having cam followers engaging end plate cams 32*a* and 32*b*. As depicted in FIG. 10 and FIG. 10*a*, each cavity is preferably bounded by two vanes and encloses a respective radial compartment that goes through two angular displacements of expanding volume alternated by two angular displacements of contracting volume. During expansion, the inner opening 46 registers with intake ports 56*a* and 56*b*, and during contraction the inner opening 46 registers with discharge ports 58*a* and 58*b*, or alternatively, with discharge passageways 63*a* and 63*b*. Thus, simultaneous diagonally opposed intake and exhaust take place as the rotor rotates. In functioning as a fluid driven motor or expander device, a pressurized fluid communicated through intake channels 62 connected to ports 56*a* and 56*b* provides a net turning force on the differential extended vane area as the cavities expand, thus causing rotation of the rotor. At the same time, the resulting rotation expels the depressurized fluid through discharge ports 58*a* and 58*b* connected to discharge channels 60 or, alternatively, expels the depressurized fluid through discharge passageways 63*a* and 63*b* as the cavities contract in volume.

Figure 11:
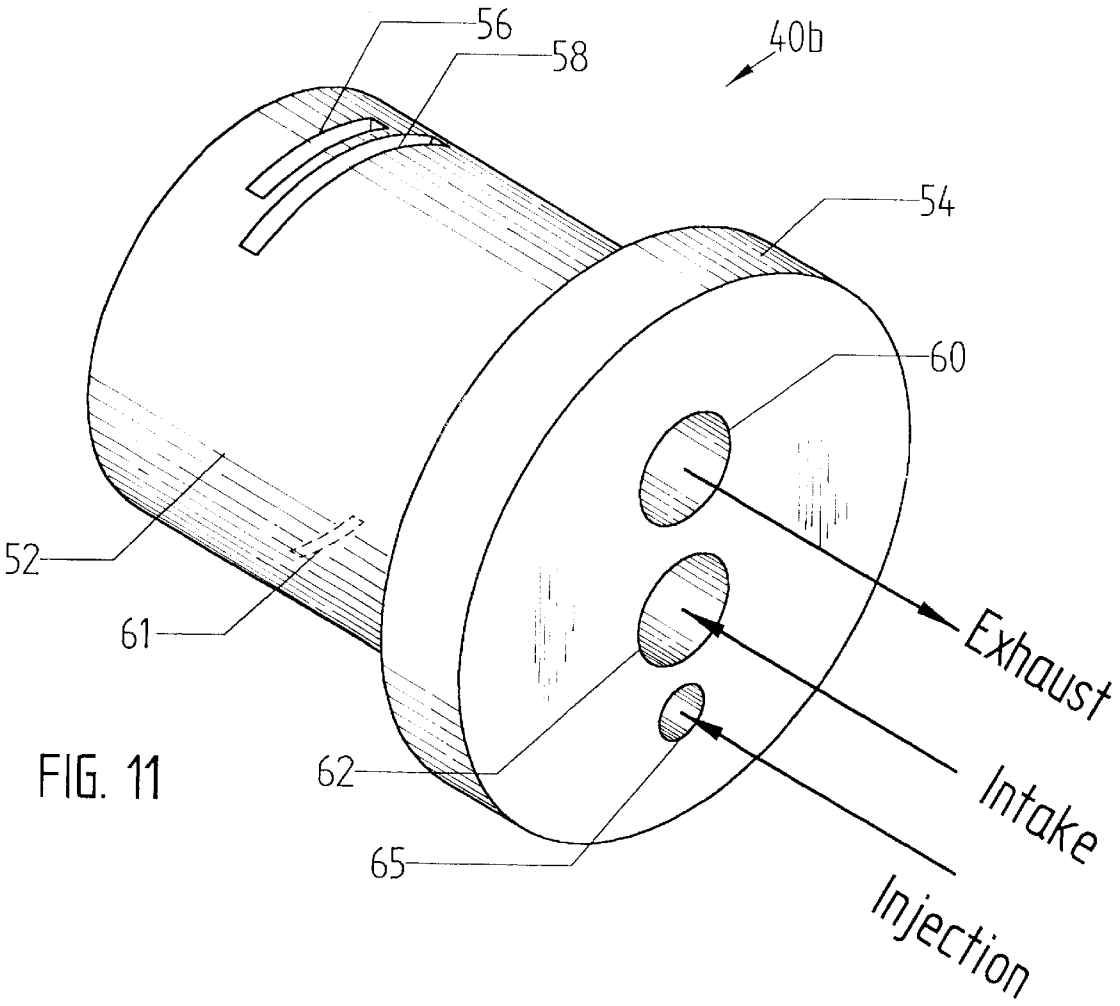
FIG. 11 is an isometric view of another alternate internal stator for a two-cycle power device of FIG. 1.
Figure 11A:
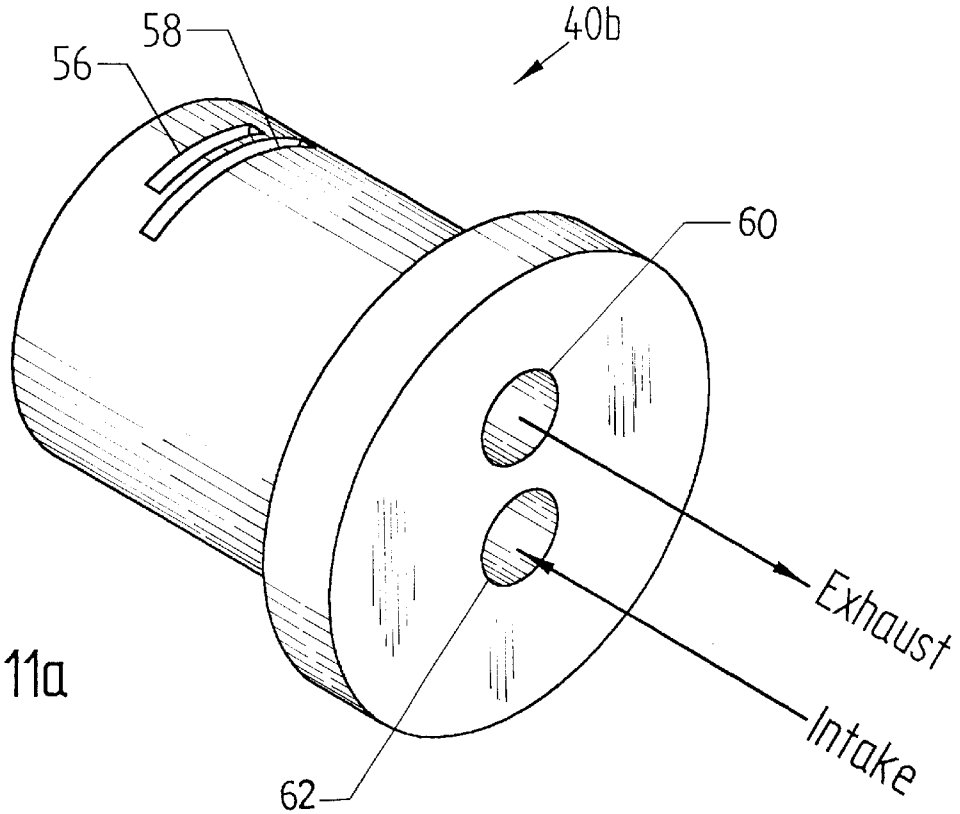
FIG. 11*a* is an isometric view of yet another alternate internal stator for a two-cycle power device of FIG. 1.
Figure 11B:
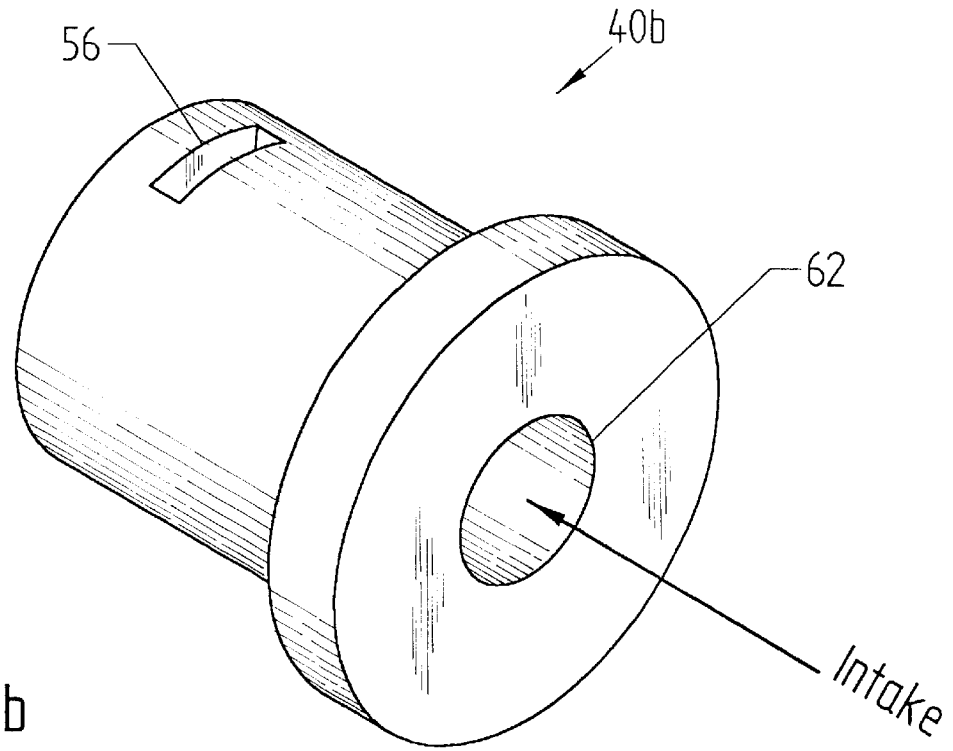
FIG. 11*b* is an isometric view of still another alternate internal stator for a two-cycle power device of FIG. 1.
Figure 11C:
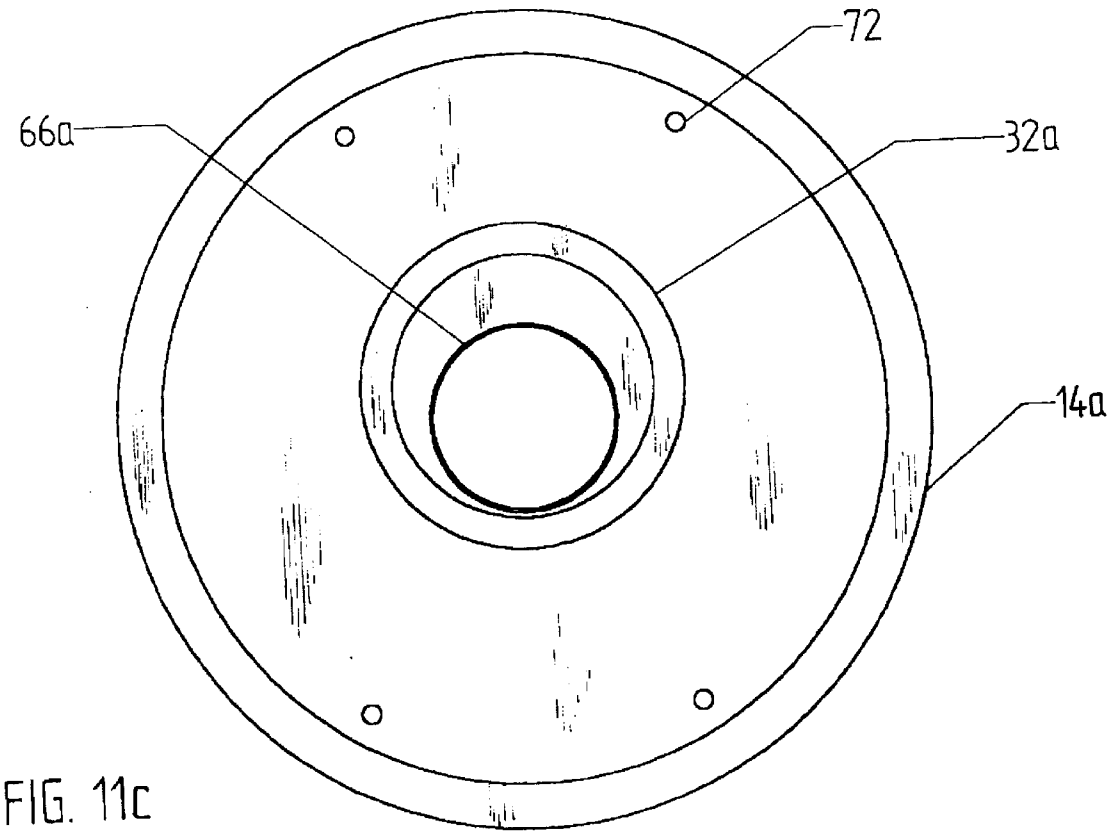
FIG. 11*c* is an alternative end plate having an eccentric cam grove corresponding to a two-cycle power device.
Figure 12:
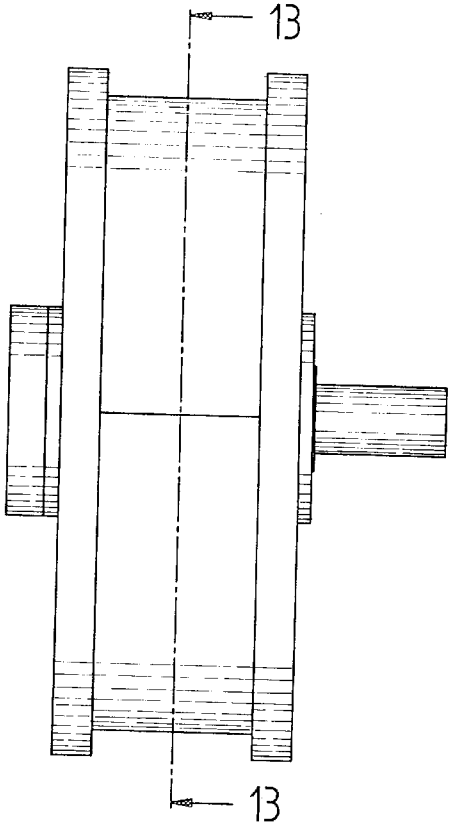
FIG. 12 is a side view of the rotary power device of FIG. 1 employing the alternate internal stator of FIG. 11.
Figure 15:
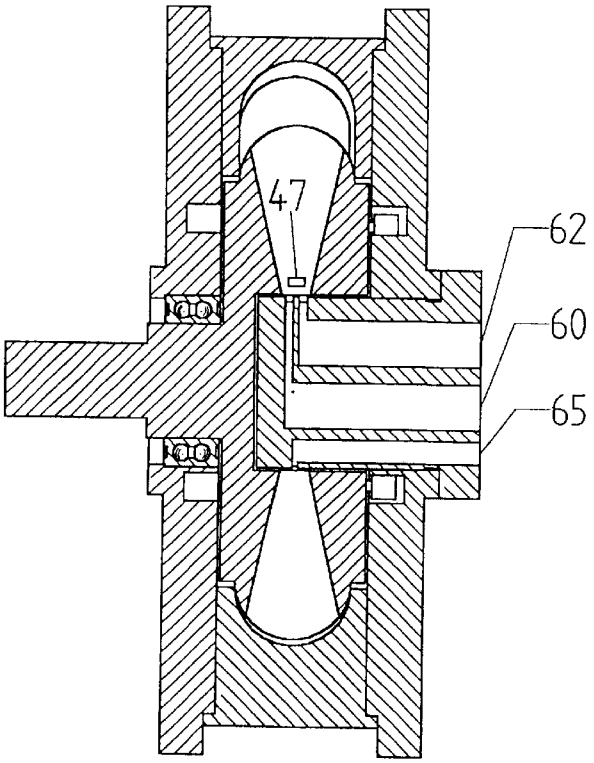
FIG. 15 is a sectional view taken along 15—15 of FIG. 14
Figure 15A:
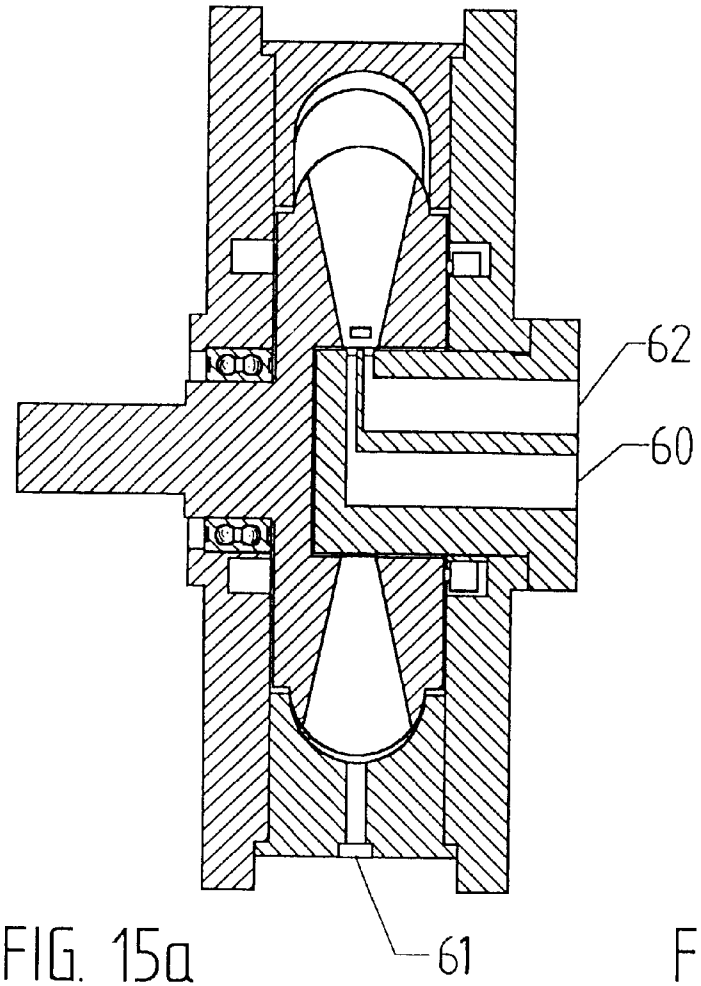
FIG. 15*a* is a sectional view taken along 15*a*—15*a* of FIG. 14*a*
Figure 15B:
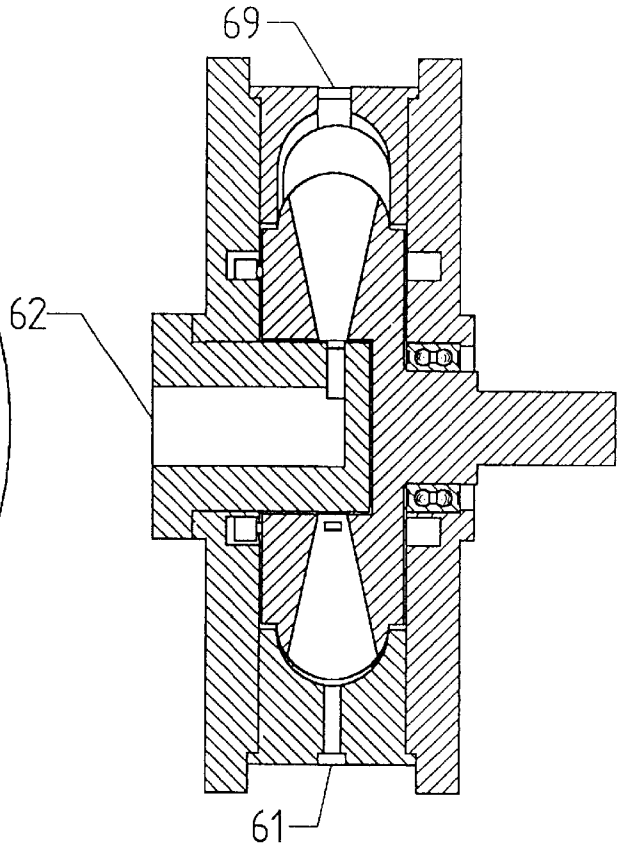
FIG. 15*b* is a sectional view taken along 15*b*—15*b* of FIG. 14*b*
Figure 14B:
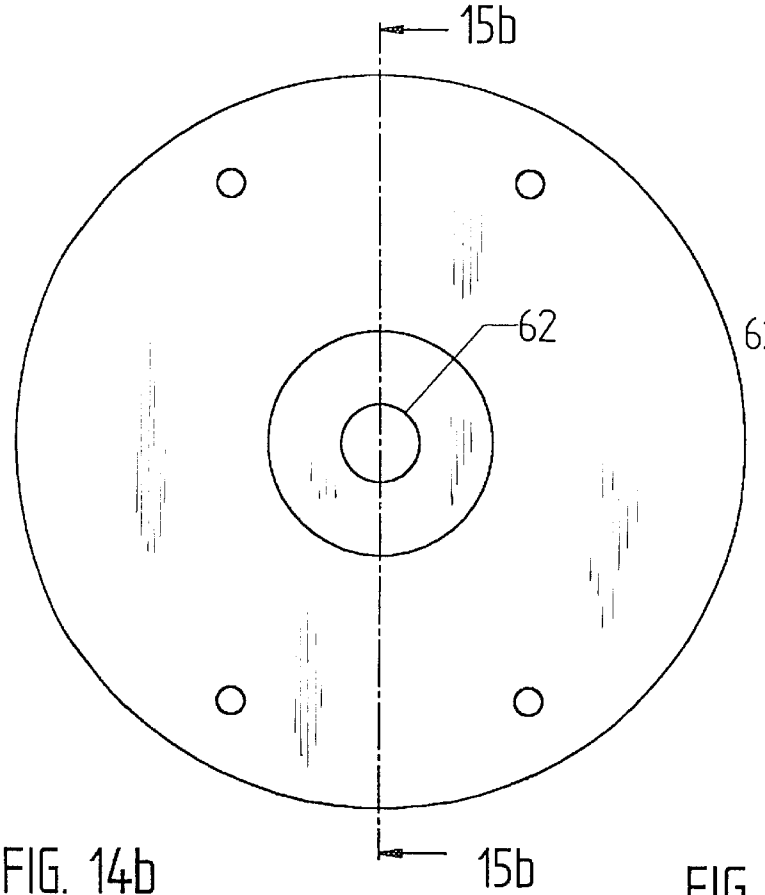
FIG. 14*b* is an end view of the rotary power device of FIG. 1 employing the alternate internal stator of FIG. 11*b*.

The rotary power device 10 can also be configured as a two-cycle internal combustion engine comprising modifications shown in FIG. 11 through FIG. 15. These modifications comprise the use of an eccentric rotor chamber profile, eccentric end cams and a modified central internal stator. In these embodiments the wall 15 of the middle portion of the external stator, when viewed in a section taken perpendicular to the shaft axis (see FIG. 13) is circular, with a center that is displaced from the axis of rotation of the shaft. The central internal stator 40*b* for the two-cycle engine comprises axially spaced apart intake port 56 and exhaust port 58, each connected to a respective intake channel 62 and exhaust channel 60. The exhaust port 58 extends over a larger angular range than does the intake port 56, and the intake port is defined within an angular displacement overlapping the exhaust 58 in order to allow for intake-exhaust scavenging. An injection port 61 is disposed approximately diametrically opposite to the intake and exhausts port and is connected to an injection channel 65. Another embodiment of the internal stator 40*b*, shown in FIG. 11*a*, comprises only intake 62 and exhaust 60 passageways, while the ignition port 61 is included in the external stator portion as shown in FIG. 15*a*. Still another embodiment of the internal stator 40*b*, depicted in FIG. 11*b*, comprises only intake passageway 62 connected to a respective peripheral intake port 56; while the external stator portion comprises an exhaust passageway 69 and an ignition port 61.

Figure 13:
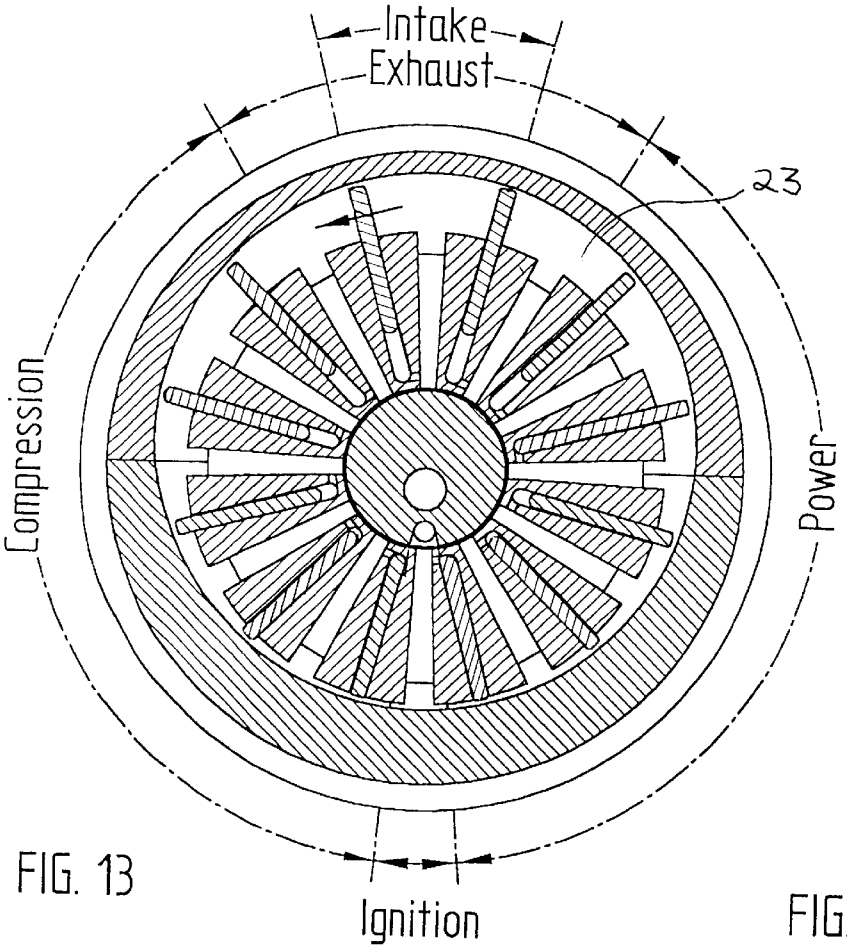
FIG. 13 is a cross-sectional view taken along line 13—13 of FIG. 12 of a rotary power device using the central stator of FIG. 11 and functioning as two-cycle internal combustion engine.
Figure 14:
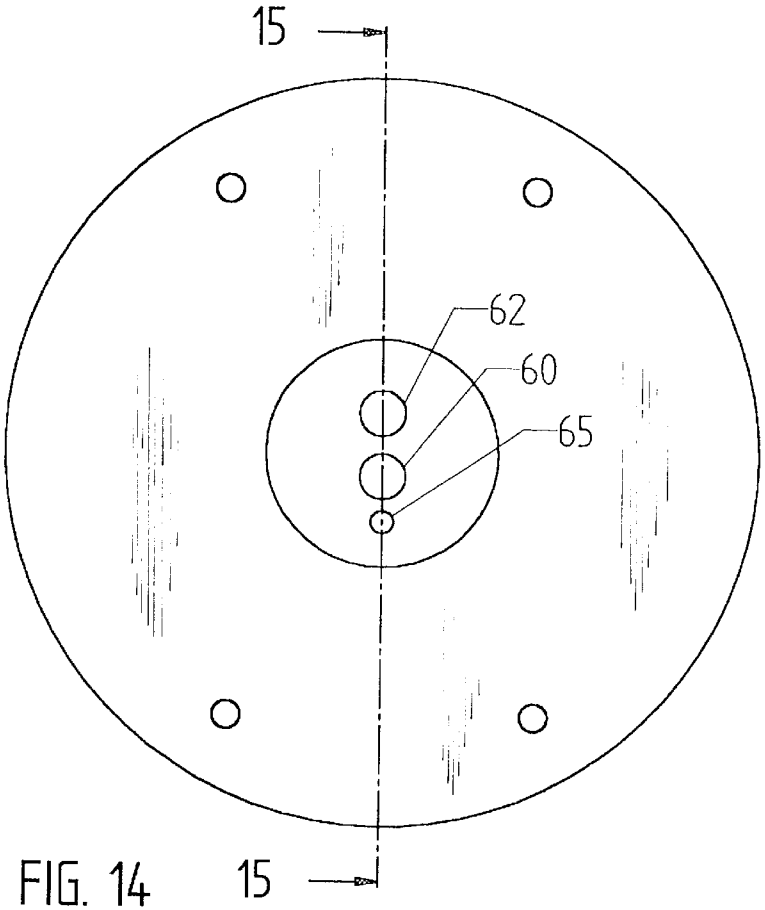
FIG. 14 is an end view of the rotary power device of FIG. 1 employing the alternate internal stator of FIG. 11.
Figure 14A:
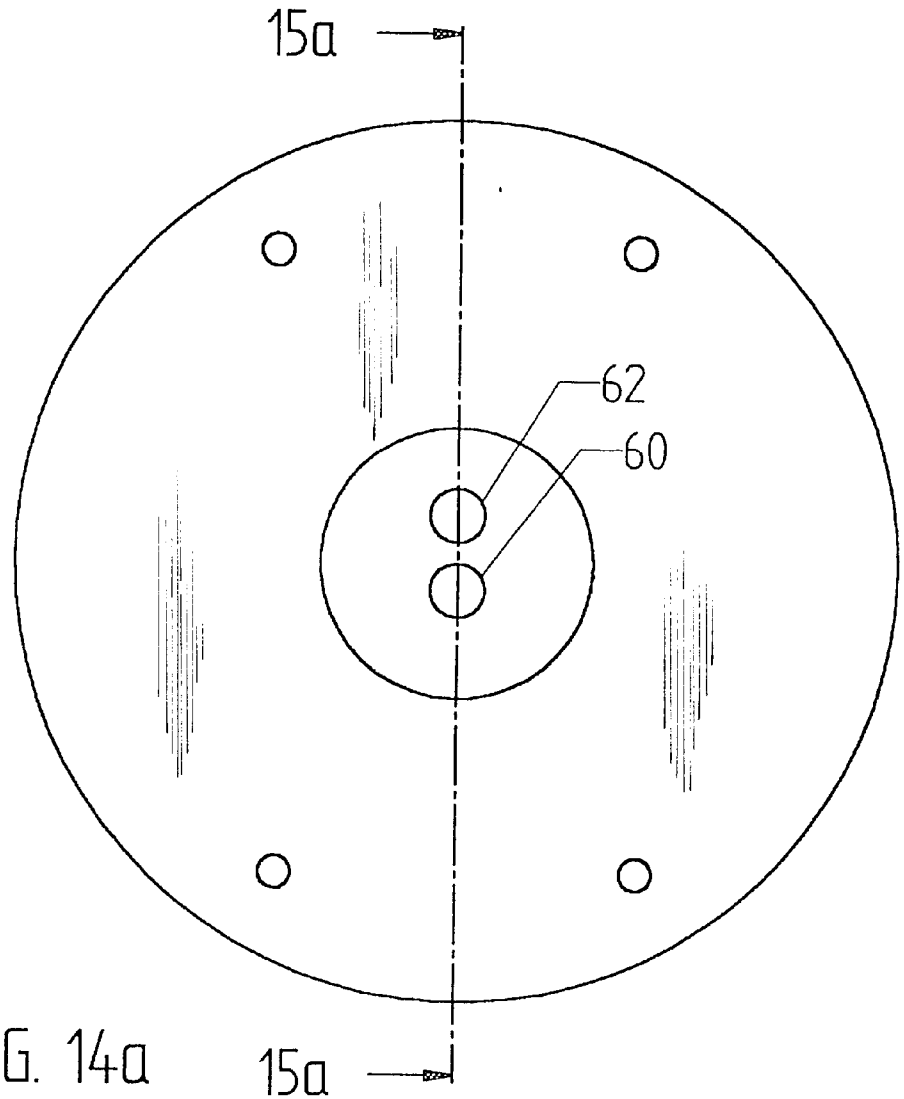
FIG. 14*a* is an end view of the rotary power device of FIG. 1 employing the alternate internal stator of FIG. 11*a*.

The operation of the two-cycle engine may be explained with reference to FIG. 13. Because of the eccentricity of the rotor chamber 23, each cavity enclosed between two vanes goes through a range of contracting volume and an equal range of expanding volume. A significant portion of the contracting volume range comprises the compression phase. Within a small range surrounding the cavity at minimum volume, ignition of the charge takes place at a port 61 by either injection of fuel in compressed air or by a glow plug or spark plug igniting a fuel/air mixture charge. Following the ignition process, the power expansion takes place for a significant portion of the expanding cavity range during which the inner openings 46 are blocked by the peripheral wall 52 of the central stator. The expansion process terminates with exhaust blow down as the open-ended compartment registers, through its inner opening 46, with an exhaust port 58 in the internal stator or, alternatively, as the open-ended compartment registers through its outer end opening with exhaust passageway 69 in the external stator. This is followed by intake-exhaust scavenging taking place within an angular range surrounding the cavity at maximum volume so that the intake 56 overlaps with either of the exhaust ports 58, 69.

Figure 16:
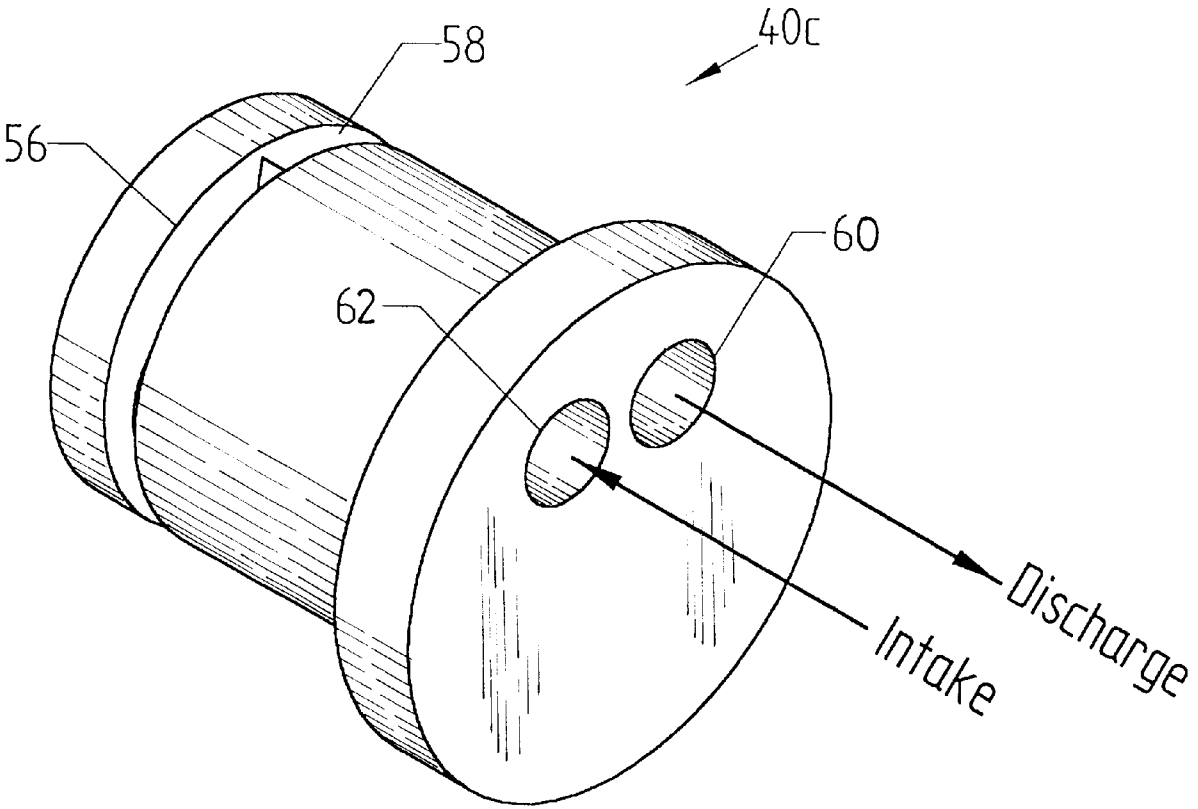
FIG. 16 is an isometric view of an alternate internal stator of the present invention.
Figure 16A:
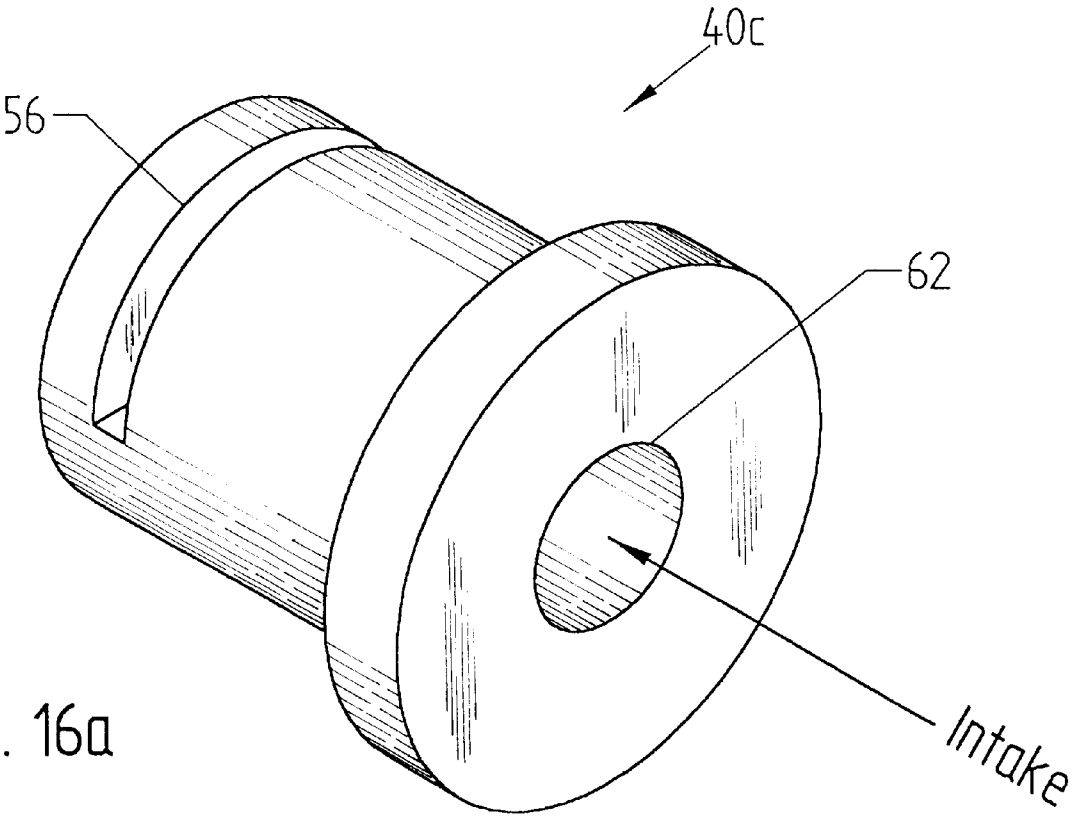
FIG. 16*a* is an isometric view of another alternate internal stator of the present invention.
Figure 18:
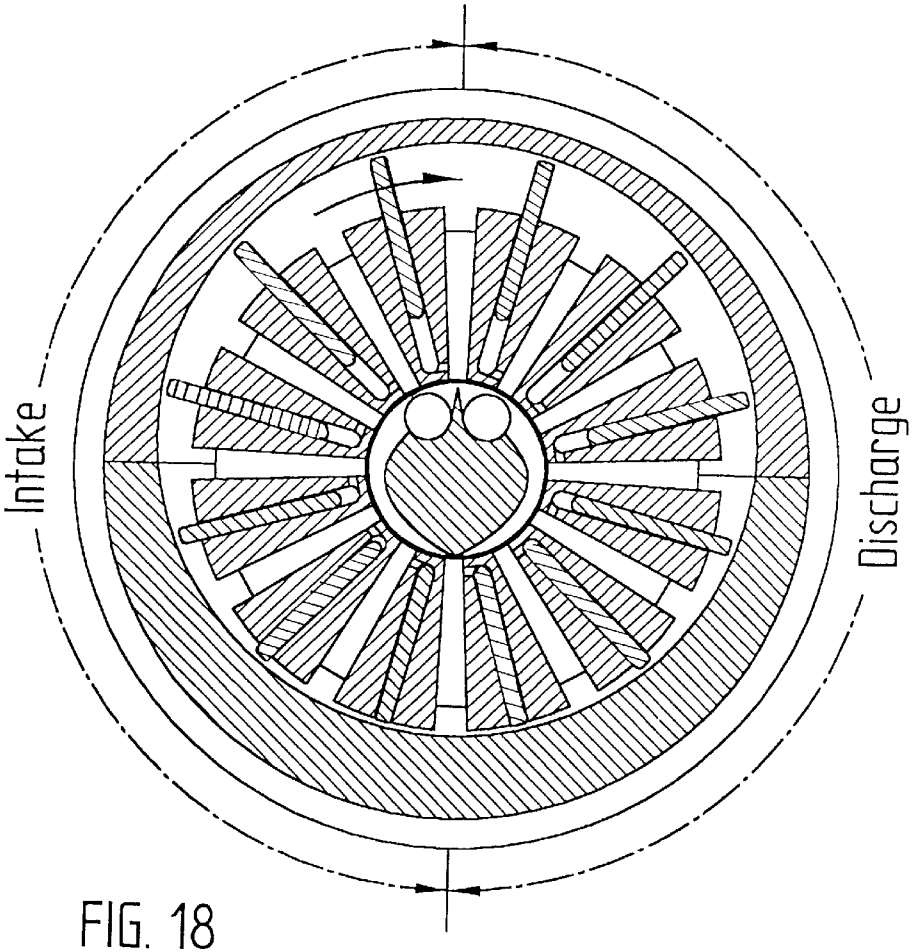
FIG. 18 is a cross-sectional view taken along line 18—18 of FIG. 17 of the device of FIG. 1 employing the alternate internal stator of FIG. 16 and functioning as a single-action pump, compressor, expander or fluid-driven motor.
Figure 17:
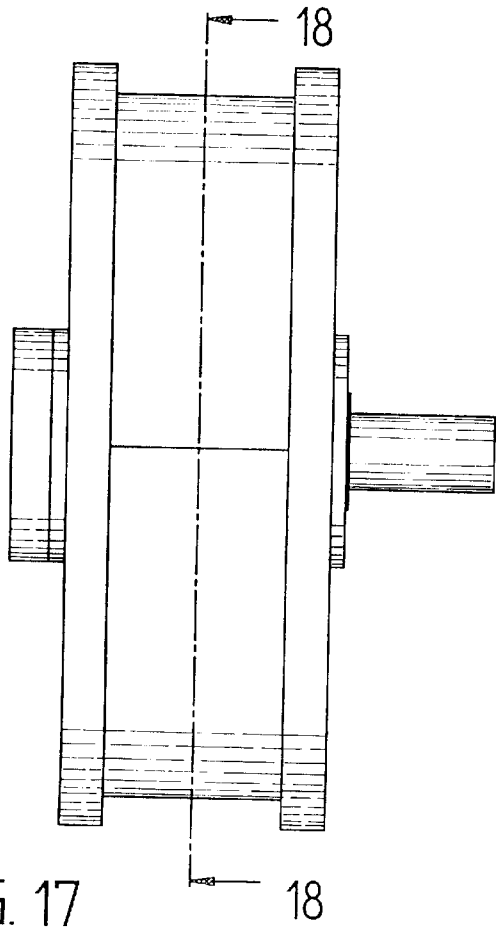
FIG. 17 is a side view of the rotary power device of FIG. 1 employing the alternate internal stator of FIG. 16.
Figure 18A:
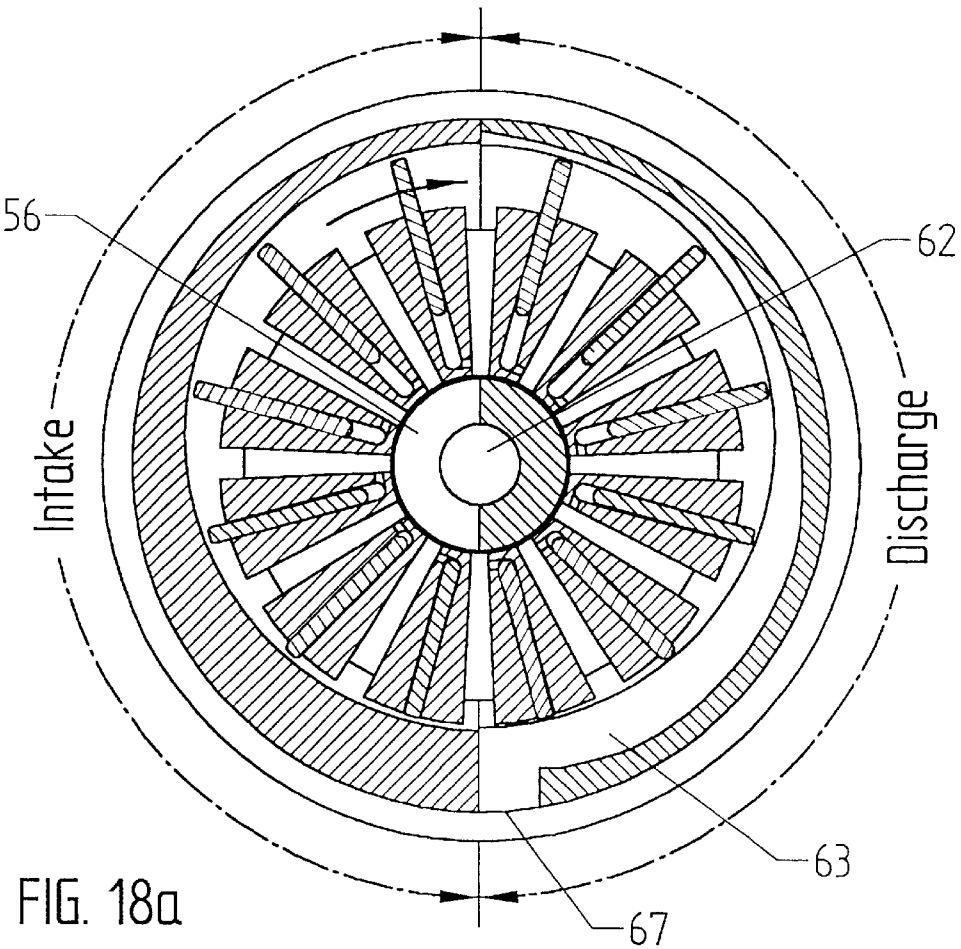
FIG. 18*a* is a cross-sectional view taken along line 18*a*—18*a* of FIG. 17*a* of the device of FIG. 1 employing the alternate internal stator of FIG. 16*a* and functioning as a single-action pump, compressor, expander or fluid-driven motor.
Figure 17A:
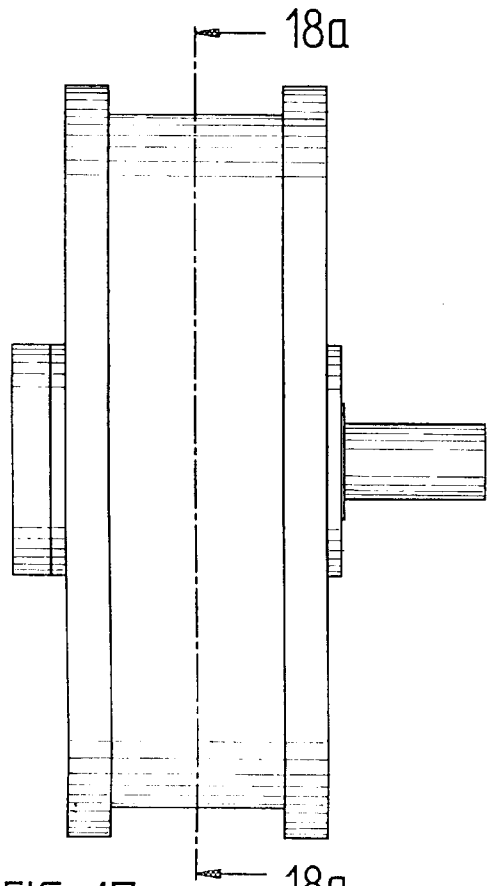
FIG. 17*a* is a side view of the rotary power device of FIG. 1 employing the alternate internal stator of FIG. 16*a*.

The two-cycle internal combustion engine described above can be transformed into a single-action pump, compressor, expander device or fluid-driven motor by replacing the internal stator 40*b* with other internal stators 40*c* shown in FIGS. 16, 16*a*. The alternative internal stator 40*c* as shown in FIG. 16 comprises an intake port 56 and an angularly adjacent discharge port 58, where each port preferably comprises a 180 degree angular cutout in the peripheral wall of the internal stator connected to respective intake 62 and exhaust channels 60. Alternatively, the internal stator 40*c*, as shown in FIG. 16*a*, comprises only an intake passageway 62 connected to a respective peripheral intake port 56*a*, defined over 180 degree of angular displacement; and the external stator portion comprises a discharge passageway 63 connected to a respective discharge port 67, as shown in FIG. 18*b*. The operation of the pump may be explained with reference to FIG. 18 and FIG. 18*a* In operation, the shaft is rotated by an external rotating means, such as a motor (not shown). Various combinations of the effects of centrifugal force, cam action, fluid pressure transmitted through transfer passage 47, and a biased spring action (not shown), causes the vane or blades 34 to make a contacting or a small clearance engagement with the toroidal peripheral wall of the chamber as the rotor rotates. A cavity enclosed by two vanes goes through a 180° range of expansion during which the inner opening 46 of each radial compartment 44 communicates with the intake port 56, so as to perform an intake phase. This is followed by a 180° range of contraction during which the open-ended compartment, through its inner opening 46, registers with the discharge port 58 in the internal stator. Alternatively, as shown in FIG. 18*a*, the compartment may register through its outer opening with the discharge passageway 63 in the external stator portion, thus performing a discharge phase.

Figure 19:
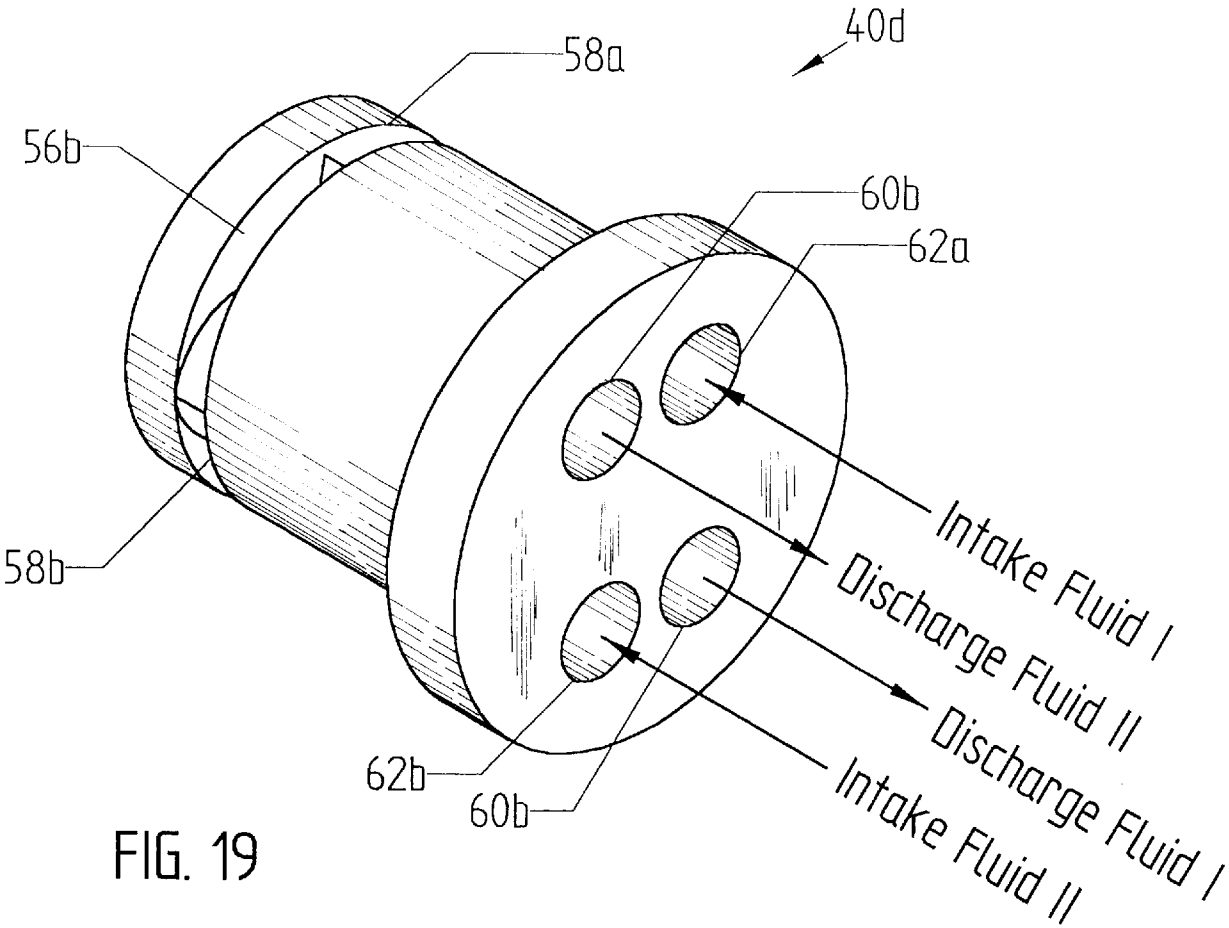
FIG. 19 is an isometric view of another alternative internal stator of the present invention.
Figure 19A:
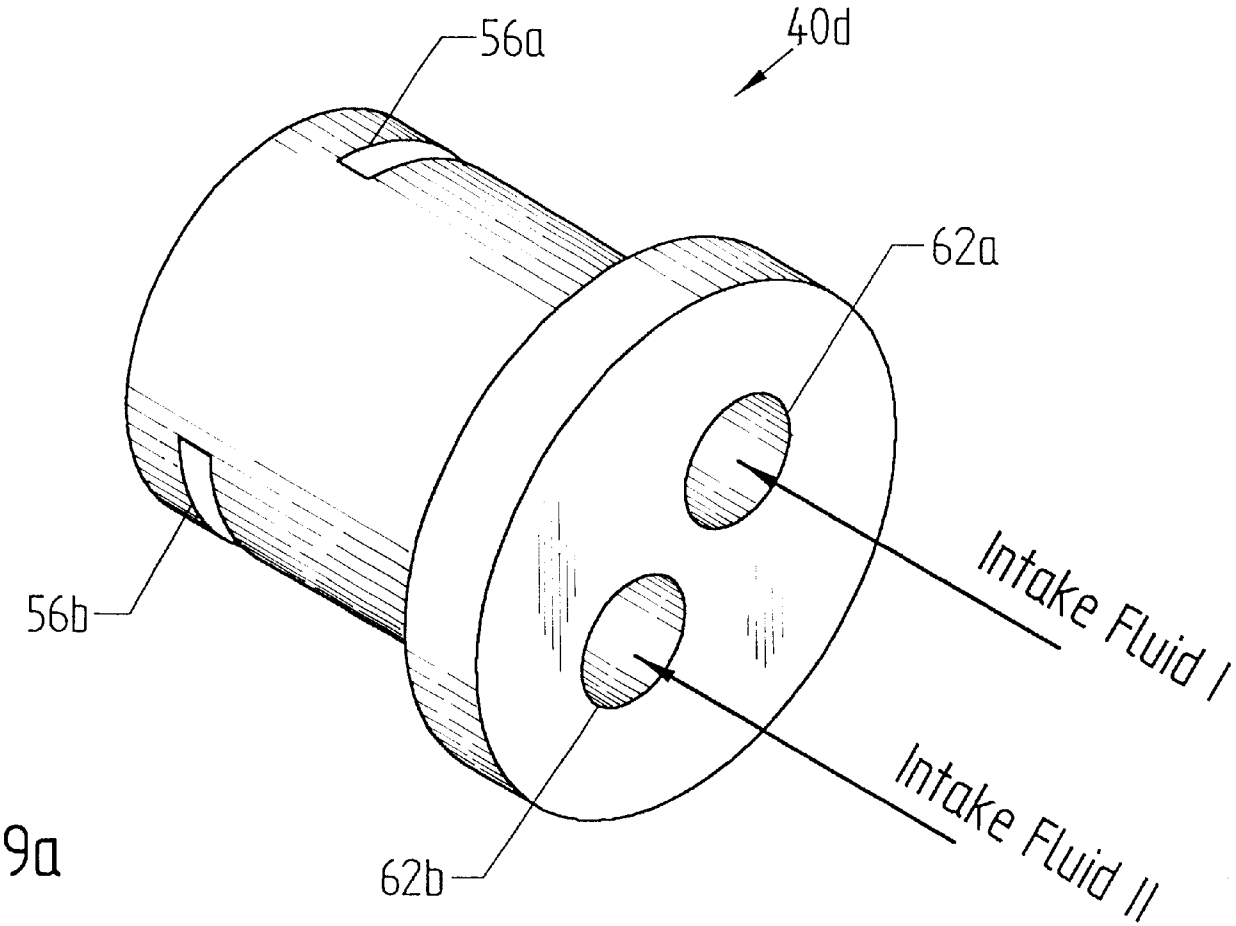
FIG. 19*a* is an isometric view of still another alternative internal stator of the present invention.
Figure 20:
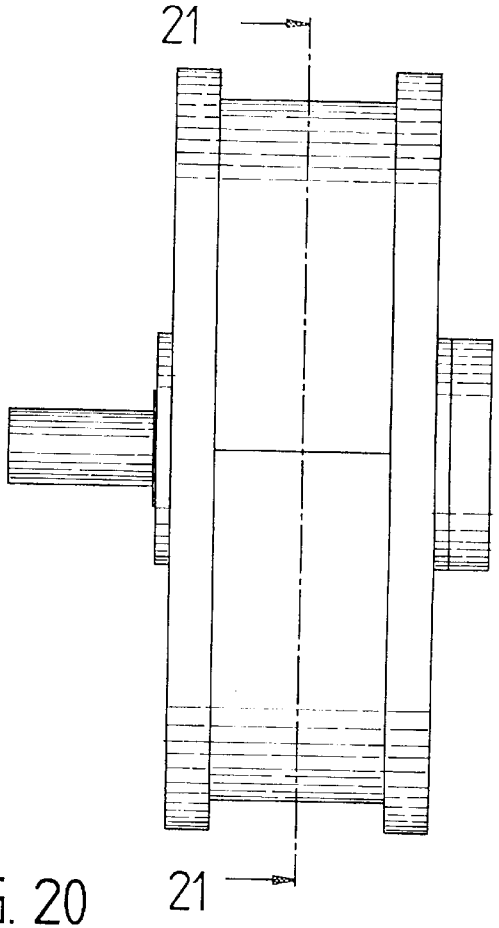
FIG. 20 is a side view of the rotary power device of FIG. 1 employing the alternative internal stator of FIG. 19.
Figure 21:
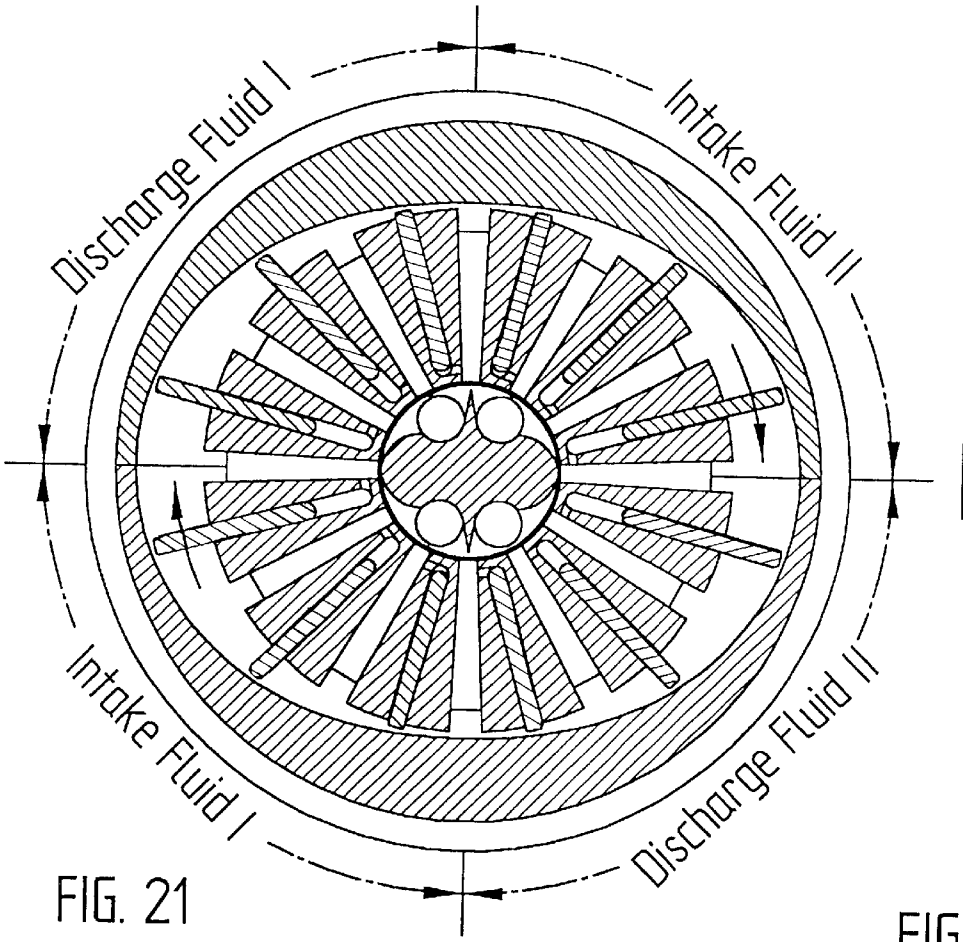
FIG. 21 is a cross-sectional view taken along line 21—21 of FIG. 20 of a rotary power device employing the alternate stator of FIG. 19, the device functioning as fluid-driven pump.
Figure 20A:
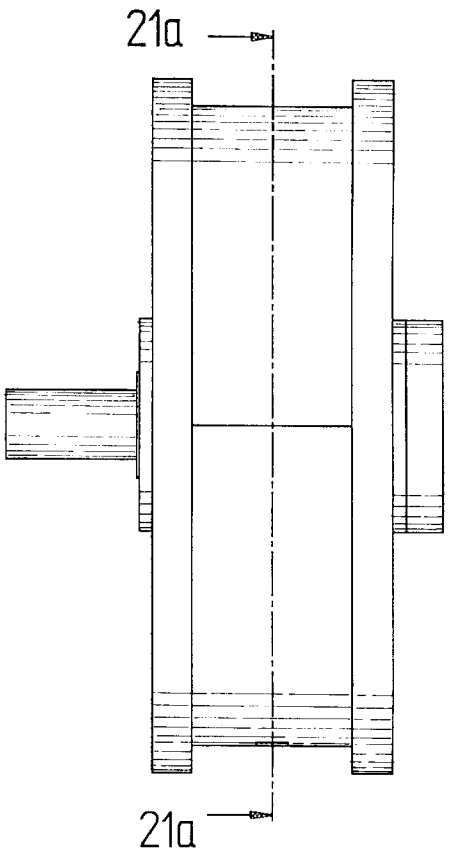
FIG. 20*a* is a side view of the rotary power device of FIG. 1 employing the alternative internal stator of FIG. 19*a*.
Figure 21A:
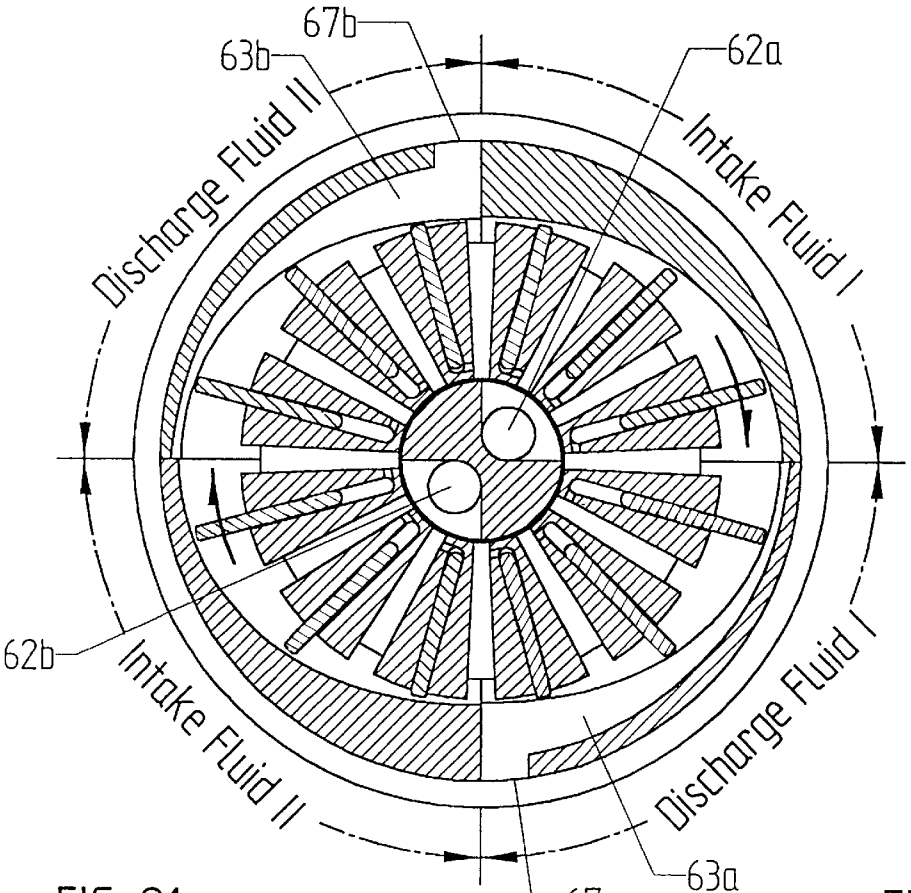
FIG. 21*a* is a cross-sectional view taken along line 21*a*—21*a* of FIG. 20*a* of a rotary power device employing the alternate stator of FIG. 19*a*, the device functioning as fluid-driven pump.

Still other embodiments of the invention provide a rotary power device operating as a fluid-driven pump or as an energy recovery device. Applications for this sort of device include a turbocharger for internal combustion engines and an energy recovery device useful in reverse osmosis plants. Examples of such apparatus are depicted in FIG. 19 through FIG. 21*a* and employ an external stator having an elliptical working chamber as has been previously described with respect to FIG. 1. In these embodiments the internal central stator 40 of the rotary power device shown in FIG. 1 is replaced with another internal stator 40*d* as shown in FIG. 19 or, alternatively, as shown in FIG. 19*a*. As shown in FIG. 19, the modified internal stator comprises four angularly adjacent ports comprising two diagonally opposed intake ports 56*a*, 56*b* connected to respective intake channels 62*a*, 62*b*, and another two diagonally opposed discharge ports 58*a*, 58*b* connected to respective discharge channels 60*a*, 60*b*. Alternatively, as shown in FIG. 19*a*, the internal stator portion may include only two diagonal intake ports 56*a*, 56*b* connected to respective intake channels 62*a*, 62*b*; while the external stator portion includes two diametrically disposed discharge passageways 63*a*, 63*b* connected to respective discharge ports 67*a*, 67*b* as shown in FIG. 21*a* In operation as fluid driven pump, a fluid I of higher pressure is communicated to one intake channel, for example 62*a*, and a second fluid II of lower pressure is communicated to a second intake channel 62*b*. The effect of net pressure forces on vanes caused by the high-pressure fluid during the intake phase is to cause rotation of the rotor and the pressurization of the lower pressure fluid. Thus, a pressure exchange takes place whereby a higher-pressure fluid experiences a pressure loss as it discharges through the exhaust channel 60*b* or alternatively through discharge passageway 63*b*; and the lower pressure fluid experiences an increase in pressure as it discharges through the channel 60*a* or alternatively, through discharge passageway 63*a*.

As will be understood by those skilled in the art, various embodiments other than those described in detail in the specification are possible without departing from the scope of the invention will occur to those skilled in the art. It is, therefore, to be understood that the invention is to be limited only by the appended claims.

What is claimed is:

1. A radial vane rotary power device comprising a stator and a rotor assembly rotatable about an axis of rotation of an end shaft protruding through a front end wall portion of the stator;

wherein the stator comprises:

an external stator portion defining an internal volume, the external stator portion comprising the front end wall portion and a back end wall portion; the front end wall portion comprising a central throughhole for receiving the end shaft, and an internal cylindrical stator portion projecting from the back end wall portion into the internal volume along an axis of rotation of the device, the internal stator portion having at least one passageway formed therein, the at least one passageway comprising an intake channel parallel to the axis and communicating with at least one radial intake port formed in a peripheral wall of the internal stator portion, and wherein the rotor assembly comprises:

a block comprising a central cylindrical bore for receiving the internal stator portion, the block rotatable within a rotor chamber portion of the internal volume lying between the internal stator portion and the external stator portion, the block comprising radial compartments equidistantly spaced apart about the axis of the device, each of the radial compartments open to a peripheral surface of the block, each of the radial compartments having a respective inner opening communicating with the at least one radial port in the peripheral wall of the internal stator portion during the course of each rotation of the rotor assembly; and radially slidable vanes, each of the vanes disposed in a respective slot within the block in alternating relation with the radial compartments.

2. The radial vane rotary power device of claim 1 further comprising transfer passages, each of the transfer passages extending between a respective compartment and a respective adjacent slot.

3. The radial vane rotary power device of claim 1 wherein the rotor chamber comprises a peripheral wall portion comprising a semi-circular profile when viewed in a section taken along the axis of rotation.

4. The radial vane rotary power device of claim 1 wherein the rotor chamber comprises a wall formed by a middle portion of the external stator said wall having a semi-circular profile defined in a plane containing the axis of rotation, the center of said semi-circular profile tracing substantially an ellipse in a plane perpendicular to the axis.

5. The radial vane rotary power device of claim 1 wherein each of the radially slidable vanes comprises a respective semi-circular outer edge portion making contact with the external stator portion.

6. The radial vane rotary power device of claim 1 further comprising a respective cam groove in each of the front end wall and back end wall portions of the external stator, each of the cam grooves for engaging the cam followers, each of cam followers connected to a respective radially slidable vane.

7. The radial vane rotary power device of claim 1 wherein the rotor chamber comprises a wall portion having a substantially oval-shaped transverse cross-section, the cross-section having a geometric center coinciding with the axis of rotation; and wherein the internal stator portion comprises at least three passageways comprising:

at least one inlet passageway comprising an intake port communicating with each radial compartment in the course of each rotation of the block;

at least one exhaust passageway comprising an exhaust port communicating with each radial compartment in the course of each rotation of the block; and at least one ignition passageway comprising an ignition port communicating with each radial compartment during each rotation of the block;

whereby the radial vane rotary power device is adapted to function as a four-cycle internal combustion engine.

8. The radial vane rotary power device of claim 1 wherein the rotor chamber comprises a peripheral wall portion having a substantially oval-shaped transverse cross-section having a geometric center coinciding with the axis of rotation; and wherein the internal stator portion comprises at least two passageways comprising:

at least one inlet passageway comprising an intake port communicating with each radial compartment in the course of each rotation of the block; and at least one exhaust passageway comprising an exhaust port communicating with each radial compartment in the course of each rotation of the block; and the external stator portion comprises an ignition port communicating with each radial compartment during each rotation of the block;

whereby the radial vane rotary power device is adapted to function as a four-cycle internal combustion engine.

9. The radial vane rotary power device of claim 1 wherein the rotor chamber comprises a peripheral wall portion having a substantially oval-shaped transverse cross-section having a geometric center coinciding with the axis of rotation; and wherein the internal stator portion comprises at least one passageway comprising: an intake port communicating with each radial compartment in the course of each rotation of the block;

the external stator portion comprises an exhaust passageway comprising an exhaust port communicating with each radial compartment in the course of each rotation of the block; and the external stator portion comprises an ignition port communicating with each radial compartment during each rotation of the block;

whereby the radial vane rotary power device is adapted to function as a four-cycle internal combustion engine.

10. The radial vane rotary power device of claim 1, wherein the rotor chamber comprises a peripheral wall portion having a substantially oval-shaped transverse cross-section having a geometric center coinciding with the axis of rotation; and wherein the internal stator portion comprises at least two passageways comprising:

at least one inlet passageway connected to a first pair of diagonally spaced apart ports, each of the first pair of ports communicating with each radial compartment in the course of each rotation of the block;

at least one discharge passageway connected to a second pair of diagonally spaced apart ports, each of the second pair of ports communicating with each radial compartment in the course of each rotation of the block;

whereby the radial vane rotary power device is adapted to function as one of a pump, a compressor, a fluid-driven motor and an expander device.

11. The radial vane rotary power device of claim 1 wherein the rotor chamber comprises a peripheral wall portion having a substantially oval-shaped transverse cross-section having a geometric center coinciding with the axis of rotation; and wherein the internal stator portion comprises exactly one inlet passageway connected to a pair of diagonally spaced apart ports, each of the ports communicating with each radial compartment in the course of each rotation of the block; and the external stator portion comprises two diametrically opposed passageways, each of the diametrically opposed passageways connected to a respective discharge port;

whereby the radial vane rotary power device is adapted to function as one of a pump, a compressor, a fluid-driven motor and an expander device.

12. The radial vane rotary power device of claim 1 wherein the rotor chamber comprises a peripheral wall portion having a substantially oval-shaped transverse cross-section having a geometric center coinciding with the axis of rotation; and wherein the internal stator portion comprises at least four passageways comprising:

a first fluid inlet passageway connected to a first inlet port communicating with each radial compartment in the course of each rotation of the block;

a first fluid discharge passageway connected to a first discharge port communicating with each radial compartment in the course of each rotation of the block;

a second fluid inlet passageway connected to a second inlet port communicating with each radial compartment in the course of each rotation of the block; and a second fluid discharge passageway connected to a second discharge port communicating with each radial compartment in the course of each rotation of the block;

whereby the radial vane rotary power device is adapted to function as one of a fluid-driven pump, a fluid-driven compressor, and a work exchanger device for recovery of energy between two differently pressurized fluids.

13. The radial vane rotary power device of claim 1 wherein the rotor chamber comprises a peripheral wall portion having a substantially oval-shaped transverse cross-section having a geometric center coinciding with the axis of rotation; and wherein the internal stator portion comprises two passageways comprising:

a first fluid inlet passageway connected to a first inlet port communicating with each radial compartment in the course of each rotation of the block; and a second fluid inlet passageway connected to a second inlet port communicating with each radial compartment in the course of each rotation of the block; and wherein the external stator portion comprises two diametrically opposed passageways comprising:

a first fluid discharge passageway connected to a first discharge port communicating with each radial compartment in the course of each rotation of the block; and a second fluid discharge passageway connected to a second discharge port communicating with each radial compartment in the course of each rotation of the block;

whereby the radial vane rotary power device is adapted to function as one of a fluid-driven pump, a fluid-driven compressor; and a work exchanger device for recovery of energy between two differently pressurized fluids.

14. The radial vane rotary power device of claim 1 wherein the rotor chamber comprises a peripheral wall portion having a substantially circular transverse cross-sectional shape having a geometric center radially offset from the axis of rotation; and wherein the internal stator portion comprises at least three passageways comprising:

at least one inlet passageway comprising an intake port communicating with each radial compartment in the course of each rotation of the block;

at least one exhaust passageway comprising a discharge port communicating with each radial compartment in the course of each rotation of the block; and at least one ignition passageway comprising an ignition port communicating with each radial compartment during each rotation of the block;

whereby the radial vane rotary power device is adapted to function as two-cycle internal combustion engine.

15. The radial vane rotary power device of claim 1 wherein the rotor chamber comprises a peripheral wall portion having a substantially circular transverse cross-sectional shape having a geometric center radially offset from the axis of rotation; and wherein the internal stator portion comprises at least two passageways comprising:

at least one inlet passageway comprising an intake port communicating with each radial compartment in the course of each rotation of the block;

at least one exhaust passageway comprising a discharge port communicating with each radial compartment in the course of each rotation of the block; and wherein the external stator portion comprises at least one ignition port communicating with each radial compartment during each rotation of the block;

whereby the radial vane rotary power device is adapted to function as two-cycle internal combustion engine.

16. The radial vane rotary power device of claim 1 wherein the rotor chamber comprises a peripheral wall portion having a substantially circular transverse cross-sectional shape having a geometric center radially offset from the axis of rotation; and wherein the internal stator portion comprises at least one inlet passageway comprising an intake port communicating with each radial compartment in the course of each rotation of the block; and the external stator portion comprises at least one exhaust passageway comprising a discharge port communicating with each radial compartment in the course of each rotation of the block; and the external stator portion further comprises at least one ignition port communicating with each radial compartment during each rotation of the block;

whereby the radial vane rotary power device is adapted to function as two-cycle internal combustion engine.

17. The radial vane rotary power device of claim 1 wherein the rotor chamber comprises a peripheral wall portion having a substantially circular transverse cross-sectional shape having a geometric center radially offset from the axis of rotation and wherein the internal stator portion comprises at least two passageways comprising:

at least one inlet passageway comprising an inlet port communicating with each radial compartment in the course of each rotation of the block; and at least one discharge passageway comprising a discharge port communicating with each radial compartment in the course of each rotation of the block;

whereby the radial vane rotary power device is adapted to function as one of a pump, a compressor, a fluid-driven motor and an expander device.

18. The radial vane rotary power device of claim 1 wherein the rotor chamber comprises a peripheral wall portion having a substantially circular transverse cross-sectional shape having a geometric center radially offset from the axis of rotation; and wherein the internal stator portion comprises at least one inlet passageway comprising an inlet port communicating with each radial compartment in the course of each rotation of the block; and the external stator portion comprises at least one discharge passageway comprising a discharge port communicating with each radial compartment in the course of each rotation of the block;

whereby the radial vane rotary power device is adapted to function as one of a pump, a compressor, a fluid-driven motor and an expander device.

19. A four-cycle rotary internal combustion engine comprising:

an external stator portion defining an internal volume having a peripheral wall portion having a substantially elliptical transverse cross-section, a front end wall portion and a back end wall portion, the front end wall portion comprising a central throughhole therethrough;

an internal stator portion comprising an axial cylindrical protrusion projecting inwardly from the back end wall portion and concentrically aligned with the internal volume, the internal stator comprising at least one inlet passageway communicating with at least one peripheral port;

a rotor assembly rotatably mounted within the internal volume, the rotor assembly comprising a block having a central bore rotatably enclosing the internal stator portion, the rotor further comprising circumferentially spaced, radially slidable vanes disposed in respective slots;

radial compartments, wherein each of the radial compartments is disposed between two of the slots, each of the radial compartments is open to a peripheral surface of the block, and each of the compartments has a respective inner opening through the peripheral wall of the central bore, each of the inner openings communicating with the at least one peripheral port at least once during the course of each rotation of the rotor block; and an end shaft protruding outwardly from one end of the rotor block through the central throughhole in the front end wall portion.

20. The four-cycle rotary internal combustion engine of claim 19 wherein the internal stator portion further comprises an exhaust passageway communicating with a peripheral exhaust port and an ignition passageway communicating with an ignition port, the ignition passageway for receiving one of a spark plug and a glow plug.

21. The four-cycle rotary internal combustion engine of claim 19 wherein the internal stator portion further comprises an exhaust passageway communicating with a peripheral exhaust port; and wherein the external stator portion comprises one of a spark plug and a glow plug.

22. The four-cycle rotary internal combustion engine of claim 19 wherein the external stator portion comprises an exhaust passageway communicating with an exhaust port; and wherein the external stator portion comprises one of a spark plug and a glow plug.

23. A rotary pump comprising:

an external stator portion defining an interior volume having a substantially elliptical shape transverse to an axis of rotation, a front end wall portion and a back end wall portion, the front end wall portion comprising a central throughhole;

an internal stator portion comprising an axial cylindrical protrusion projecting inwardly from the back end wall portion, the cylindrical protrusion concentrically aligned with the interior volume, the internal stator comprising at least one inlet passageway communicating with at least two diametrically opposed peripheral ports;

a rotor assembly rotatably mounted within an annular chamber defined by the external stator portion and the internal stator portion, the rotor assembly comprising:

a block having a central bore rotatably enclosing the internal stator portion;

circumferentially spaced, radially slidable vanes disposed in respective slots; and radial compartments circumferentially disposed in alternation with the slots; wherein each of the radial compartments has a respective inner opening through the peripheral wall of the central bore, and each of the inner openings communicates with each of the at least two diametrically opposed peripheral ports exactly once during the course of each rotation of the rotor assembly; and wherein the rotor assembly further comprises an end shaft protruding outwardly from the block through the central throughhole in the front end wall portion.

24. The rotary pump of claim 23 wherein the internal stator portion further comprises a discharge passageway communicating with each of a second pair of diametrically opposed peripheral discharge ports.

25. The rotary pump of claim 23 wherein the external stator portion comprises two diametrically opposed passageways, each passageway comprising a groove in the inner peripheral wall portion communicating with a respective discharge port.

26. A rotary expander device having an axis of rotation, the device comprising a rotor assembly concentrically mounted within an annular chamber defined by an external stator portion and an axially projecting cylindrical internal stator portion, an inner wall of the external stator portion comprising a substantially elliptical cross section transverse to the axis, the internal stator portion comprising at least one inlet passageway communicating with at least two diametrically opposed peripheral ports; wherein the rotor assembly comprises:

a block having a central bore rotatably enclosing the internal stator portion and an end shaft protruding through a central throughhole in one end of the external stator;

circumferentially spaced, radially disposed slidable vanes received in respective slots; and radial compartments, wherein each of the radial compartments is disposed between two of the slots, each of the radial compartments has a respective outer end open to a peripheral surface of the block, and each of the radial compartments has a respective inner opening communicating with the central bore, each of the inner openings communicating exactly once with each of the at least two diametrically opposed peripheral ports in the internal stator portion during the course of each rotation of the block.

27. A fluid-driven pump comprising:

a rotor assembly concentrically mounted within an annular chamber defined by an external stator portion having an inner wall having a substantially elliptical shape transverse to an axis of rotation of the rotor and an axially projecting cylindrical internal stator portion;

the internal stator portion comprising at least first and second inlet passageways, each of the inlet passageways communicating with a respective source of a respective fluid;

the rotor assembly comprising:

a block having a central bore rotatably enclosing the internal stator portion and an end shaft protruding through an axial hole in an end of the external stator;

circumferentially spaced, radially disposed slidable vanes, each received in a respective slot;

radial compartments, each of the radial compartments disposed between two respective ones of the slots, each of the radial compartments having a respective inner opening to the central bore, each of the openings alternatively communicating with the first and second inlet ports in the internal stator portion.

28. A two-cycle internal combustion engine comprising:

an output shaft extending along an axis of rotation from a rotor block;

an external stator portion having a cylindrical interior wall disposed about a cylinder axis parallel to and radially spaced apart from the axis of rotation, a front end wall portion perpendicular to the cylinder axis and to the axis of rotation, and a back end wall portion perpendicular to the cylinder axis and to the axis of rotation, the front end wall portion comprising a throughhole coaxial with the axis of rotation;

an internal stator portion comprising a cylindrical protrusion projecting inwardly from the back end wall portion along the axis of rotation, the internal stator comprising at least one inlet passageway communicating with at least one peripheral port;

a rotor assembly rotatably mounted within the annular chamber defined by the external stator portion and the internal stator portion, the rotor assembly comprising:

the rotor block having a central bore rotatably and concentrically enclosing the internal stator portion;

circumferentially spaced, radially disposed slidable vanes, each vane received in a respective slot; and radial compartments, each of the radial compartments disposed between two respective ones of the slots, each of the radial compartments having a respective inner opening through the peripheral wall of the central bore communicating with the at least one peripheral port once during the course of each rotation of the rotor.

29. The two-cycle rotary internal combustion engine of claim 28 wherein the internal stator portion further comprises an exhaust passageway and one of a spark plug and a glow plug.

30. The two-cycle rotary internal combustion engine of claim 28 wherein the internal stator portion further comprises one exhaust passageway; and wherein the external stator portion comprises one of a spark plug and a glow plug.

31. The two-cycle rotary internal combustion engine of claim 28 wherein the external stator portion comprises an exhaust passageway and one of a spark plug and a glow plug.

32. A rotary pump comprising:

a shaft extending along an axis of rotation from a rotor block;

an external stator portion having a cylindrical interior wall disposed about a cylinder axis parallel to and radially spaced apart from the axis of rotation, a front end wall portion perpendicular to the cylinder axis and to the axis of rotation, and a back end wall portion perpendicular to the cylinder axis and to the axis of rotation, the front end wall portion comprising a throughhole coaxial with the axis of rotation;

an internal stator portion comprising a cylindrical protrusion projecting inwardly from the back end wall portion along the axis of rotation, said internal stator portion comprising at least one inlet passageway leading to at least one peripheral port;

a rotor assembly rotatably mounted within the annular chamber defined by the external stator portion and the internal stator portion, said rotor assembly comprising:

the rotor block having a central bore rotatably and concentrically enclosing the internal stator portion;

circumferentially spaced, radially disposed slidable vanes, each of the circumferentially spaced, radially disposed slidable vanes received in a respective slot; and radial open-ended compartments, each of the radial open-ended compartments disposed between a respective two of the slots, each of the radial open-ended compartments having a respective inner opening through the peripheral wall of the central bore communicating with the at least one peripheral port.

33. The rotary pump of claim 32 wherein the internal stator portion further comprises a discharge passageway.

34. The rotary pump of claim 32 wherein the external stator portion comprises a discharge passageway comprising a groove in the inner peripheral wall, the groove communicating with a discharge port.

35. A radial vane rotary power device operable as one of a fluid-driven motor and a rotary expander, the device comprising a stator and a rotor assembly rotatable about an axis of rotation of an end shaft protruding through one end of the stator;

the stator defining a chamber extending between an external stator portion having an inner wall having a substantially circular transverse cross-sectional shape when viewed in a section taken perpendicular to the axis of rotation, and a cylindrical internal stator portion having an axis that is coaxial with the axis of rotation and spaced apart from a center of the circular shape of the inner wall of the external portion, the internal stator portion comprising at least one passageway communicating with at least one intake port;

the rotor assembly comprising:

a block having a central bore rotatably enclosing the internal stator portion;

circumferentially spaced, radially disposed slidable vanes, each of the radially disposed slidable vanes received in a respective slot; and radial open-ended compartments disposed so that each of the radial open-ended compartments is disposed between two respective ones of the slots, each of the radial open-ended compartments having a respective inner opening to the central bore communicating with the at least one intake port in the internal stator portion.

* * * * *